United States Patent [19]

Hall et al.

[11] Patent Number: 4,630,517

[45] Date of Patent: Dec. 23, 1986

[54] SHARING SOUND-PRODUCING CHANNELS IN AN ACCOMPANIMENT-TYPE MUSICAL INSTRUMENT

[76] Inventors: Robert J. Hall, 20756 Tribune St., Chatsworth, Calif. 91311; George R. Hall, 13613 Huston St., Sherman Oaks, Calif. 91423; Jack C. Cookerly, 26916 Barbacoa Pl., Saugus, Calif. 91350

[21] Appl. No.: 621,327

[22] Filed: Jun. 15, 1984

Related U.S. Application Data

[63] Continuation-in-part of Ser. No. 274,606, Jun. 17, 1981, Pat. No. 4,508,002.

[51] Int. Cl.[4] ..... G10H 1/22; G10F 1/00

[52] U.S. Cl. ..... 84/1.01; 84/1.03

[58] Field of Search ..... 84/1.01, 1.03, DIG. 22, 84/1.17

[56] References Cited

U.S. PATENT DOCUMENTS

| | | | |
|---|---|---|---|
| 4,269,102 | 5/1981 | Kondo et al. | 84/1.01 |
| 4,321,850 | 3/1982 | Oya et al. | 84/1.01 |
| 4,350,068 | 9/1982 | Suzuki et al. | 84/1.03 |
| 4,365,532 | 12/1982 | Nakada et al. | 84/DIG. 22 |
| 4,387,617 | 6/1983 | Kato et al. | 84/1.01 |
| 4,433,601 | 2/1984 | Hall et al. | |
| 4,450,745 | 5/1984 | Nakada et al. | 84/DIG. 22 |
| 4,508,002 | 4/1985 | Hall et al. | |

*Primary Examiner*—William M. Shoop, Jr.
*Assistant Examiner*—Sharon D. Logan
*Attorney, Agent, or Firm*—Nilsson, Robbins, Dalgarn, Berliner, Carson & Wurst

[57] ABSTRACT

In a method for providing musical accompaniment in response to the playing of a musical instrument, wherein the accompaniment has a plurality of musical components performing different musical functions, a preselected number of virtual channels implementing the musical components of the accompaniment are mapped into a smaller number of physical channels such that the allocation of physical channels between the musical components fluctuates over time. In another embodiment, one of the musical components of the accompaniment is a fill note component, and the allocation of physical channels between it and at least one other component of the accompaniment may be either static or dynamic.

14 Claims, 42 Drawing Figures

SAMPLE KEYPAD

| | |
|---|---|
| 0–9 | DIGIT ENTRY |
| CANCEL | ERROR |
| STYLE | SELECT STYLE |
| I | INTRO |
| E | ENDING |
| A | AUTO STOP |
| V1 | VARIATION 1 |
| V2 | VARIATION 2 |
| ↑↓ | MISC. VOL CONTROLS |
| TEMPO ↑↓ | TEMPO VARIATION |

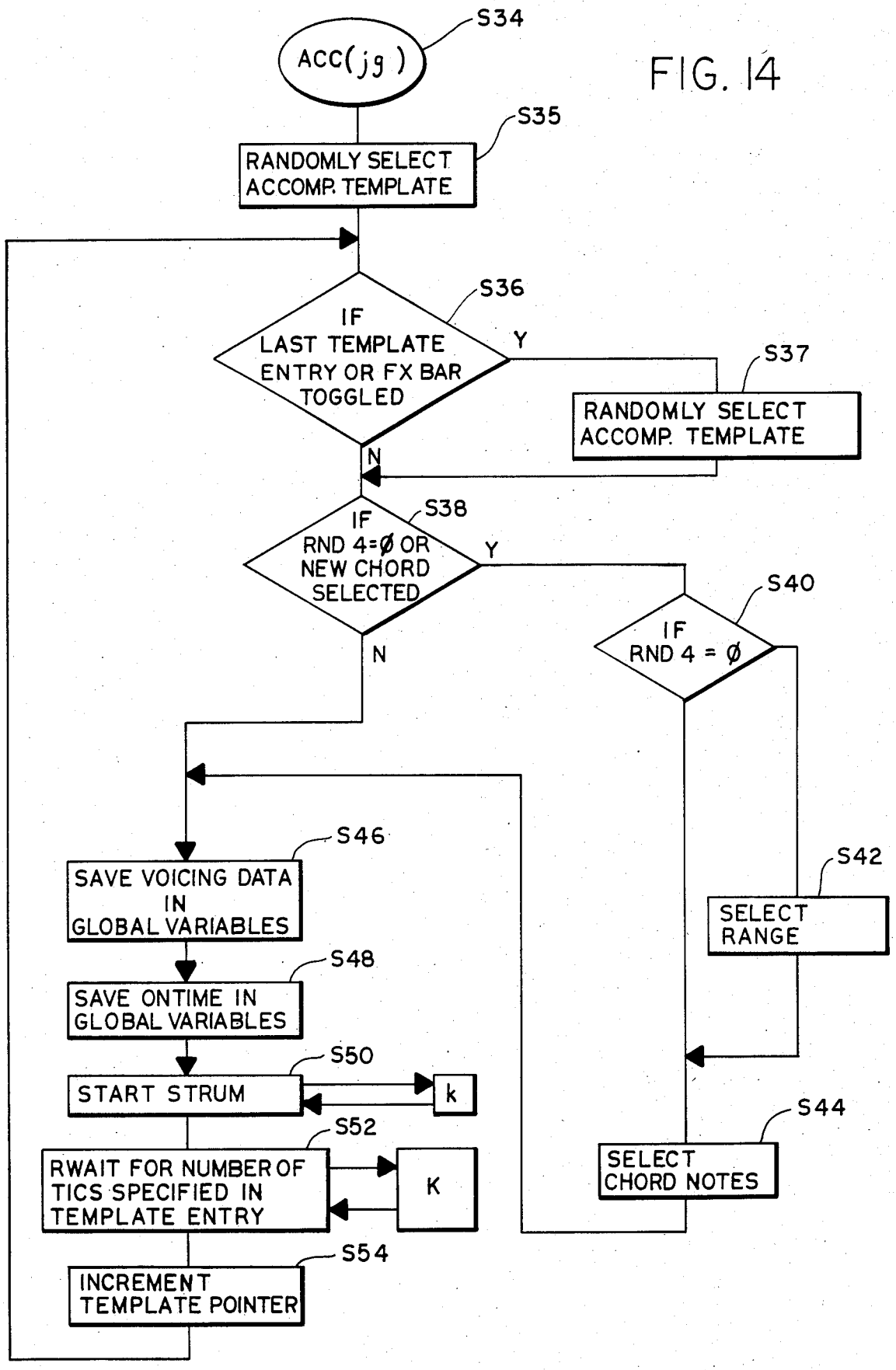
ACC(jg)
S34
FIG. 14
S35
RANDOMLY SELECT ACCOMP. TEMPLATE
S36
IF LAST TEMPLATE ENTRY OR FX BAR TOGGLED
Y
S37
RANDOMLY SELECT ACCOMP. TEMPLATE
N
S38
IF RND 4=Ø OR NEW CHORD SELECTED
Y
S40
IF RND 4 = Ø
N
S46
SAVE VOICING DATA IN GLOBAL VARIABLES
S42
SELECT RANGE
S48
SAVE ONTIME IN GLOBAL VARIABLES
S50
START STRUM
k
S44
S52
RWAIT FOR NUMBER OF TICS SPECIFIED IN TEMPLATE ENTRY
K
SELECT CHORD NOTES
S54
INCREMENT TEMPLATE POINTER

SEPTEMBER IN THE RAIN

TAMBORINE SAMBA

SHARING SOUND-PRODUCING CHANNELS IN AN ACCOMPANIMENT-TYPE MUSICAL INSTRUMENT

CROSS REFERENCE TO RELATED APPLICATIONS

This is a continuation-in-part of copending U.S. patent application Ser. No. 274,606, now U.S. Pat. No. 4,508,002 filed June 17, 1981 for "Method and Apparatus for Improved Automatic Harmonization", and is filed concurrently with applications of the applicants herein for "Enhanced Characteristics Musical Instrument", and "Accompaniment Note Selection Method". The specification of each of these applications is hereby incorporated by reference.

BACKGROUND OF THE INVENTION

The present invention relates to electronic musical instrumentation and, more particularly, to a musical instrument in which physical sound-producing channels are shared between virtual channels corresponding to different musical components of the accompaniment.

A number of systems have been proposed for providing accompaniment to the playing of a musical instrument, such as an organ. A rather successful scheme is disclosed in U.S. Pat. No. 4,433,601, issued to Hall, et al. for "Orchestral Accompaniment Techniques." In the patented system, accompaniment is provided for a plurality of "musical styles" selectable by a player. The accompaniment contains chordal, bass and percussion lines integrated together in prescheduled sequences of musical events and stored in tabular form. When a harmony is selected by the player, an appropriate set of instructions is processed sequentially to sound the accompaniment. Harmonies produced by the accompaniment depend upon player input, but the sequences themselves cannot be altered from their prescheduled form.

Another form of automatic accompaniment is disclosed in the above-referenced U.S. patent application Ser. No. 274,606. The art existing prior to the method of that application was capable of embellishing a melody by adding notes limited to the chosen harmony notes sounded a preselected musical compass below the melody. Such art was unable to produce fill notes, which were not tones of the harmony recognized by the instrument. This is a drawback when musicians of limited ability and/or dexterity seek to sustain the accompaniment by playing a minimum number of harmony notes. The invention of the referenced application incorporates significant aspects of musicianship into the automated instrument art by providing a system in which fill notes are derived on the basis of the harmonic relationship between a played melody and a recognized chord. Harmonization is achieved through the use of tabular listings of notes which are not limited to the recognized chord. Data storage requirements are minimized through a system of accompaniment note identification based upon musical transposition.

Most prior art organs achieve multiple voicing by applying signals to a plurality of hardware channels dedicated to individual components of the music. Sound producing channels were assigned when the instrument was registered and did not vary as a function of the musical input. The instrument of U.S. Pat. No. 4,433,601 went beyond the prior art by sharing sound producing channels among the notes of an individual component of the musical output. Physical sound producing channels were shared between "virtual" channels of the chordal component of the accompaniment, but such sharing did not take place between the various functional components of the accompaniment. Consequently, the hardware of such instruments involved substantial duplication of resources. At any point in time, a large number of output channels were necessarily unused. In addition, the output of each virtual channel was sounded in all cases, sometimes leading to a cluttered feeling on the part of the listener.

SUMMARY OF THE INVENTION

In a method for providing musical accompaniment in response to the playing of a musical instrument, wherein the accompaniment has a plurality of musical components performing different musical functions, the improvement comprising the steps, accomplished by the instrument itself, of: providing access to a first preselected number of physical sound producing channels; generating accompaniment information for a second preselected number of virtual channels to implement the plurality of musical components, the second preselected number exceeding the first preselected number at least once during the playing of the instrument; and mapping the virtual channels into the physical channels such that the allocation of physical channels between the musical components fluctuates over time. In one preferred embodiment, the virtual channels are assigned different priorities and are mapped into the physical channels according to said priorities. Alternatively, the virtual channels may be assigned equal priority and be mapped into the physical channels in the order that accompaniment information is generated on them. Two musical components of the accompaniment may comprise a chordal component and a fill note component, respectively. In another aspect the virtual channels are mapped into the physical channels such that the physical channels are allocated between the fill note component and at least one other musical component of the accompaniment, either dynamically or statically. The present invention also encompasses apparatus and software for implementing the above process.

The method of the present invention provides automatic accompaniment in a system modeled after a small musical group having a functional conductor, arranger, orchestrator and musicians. Critical timing decisions on the commencement and duration of tones, and decisions on the choice of tones to be played, are made independently by the "musicians" within the confines of an arrangement and orchestration programmed for a selected musical style. The conductor sets the pace and controls the flow of the accompaniment.

Independent decision making is accomplished by factoring the accompaniment into different musical lines or "components", each of which exists as a separate accompaniment process, and executing the processes pseudo-concurrently in a single processing system. The system allocates processing resources on an as-needed basis to produce a coherent musical accompaniment in which the different components are superimposed on one another.

Because the processes corresponding to different lines of accompaniment are stored separately and are run in psuedo-concurrent fashion, they can be varied individually to produce a less regimented effect. In addition, the process data can be efficiently managed to provide a wide variety of accompaniment combinations.

The method and apparatus disclosed herein also assigns hardware resources (physical sound-producing channels of the instrument) between virtual channels implementing different functional musical components of the instrument. This permits a relatively small number of programmable channels to perform the sophisticated musical accompaniment of the present invention. Because the different components of the present accompaniment are generated from separately stored and running processes it is possible to allocate resources upon a prioritization or other algorithm which maximizes the musical effect without increasing the number of physical channels. In some cases, certain of the notes are suppressed in favor of sounding other, more significant notes. The absence of weaker notes may be masked to some extent by the presence of a more dominant note, and in some cases, the absence eliminates a feeling of "clutter" or confusion which would otherwise result from coincidence of several musical lines.

BRIEF DESCRIPTION OF THE DRAWINGS

The above and other features of the present invention may be more fully understood from the following detailed description, taken together with the accompanying drawings, wherein similar characters refer to similar elements throughout and in which:

FIG. 14 is a simplified block diagram of a chordal accompaniment process for a jazz guitar style used in a preferred embodiment of the present invention;

FIG. 10 is a simplified block diagram of a routine for terminatng accompaniment fill notes according to the teachings of the present invention;

DESCRIPTION OF THE PREFERRED EMBODIMENTS

Figure 1:
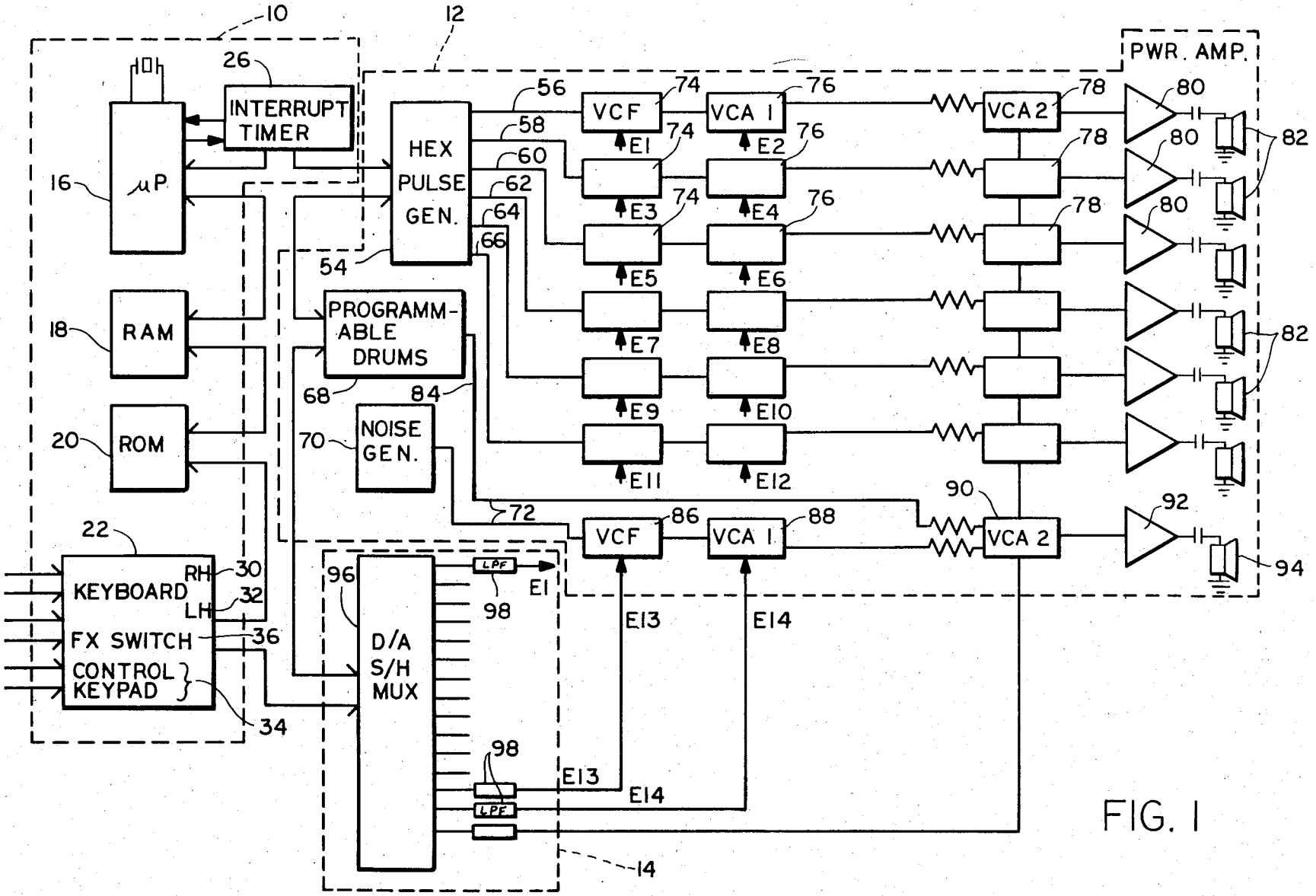
FIG. 1 is a generalized schematic diagram showing the hardware of a musical instrument conducted according to a preferred embodiment of the present invention.

The present invention relates primarily to a system of producing accompaniment to the playing of a keyboard musical instrument, such as an electronic organ. A commercial form of the invention is described in "Lowrey Service Manual: Genius(Model G-100)," published by Lowrey Music Company, a division of Norlin Industries, 707 Lake Cook Road, Deerfield, Ill. 60015. The service manual discloses many of the hardware and operational details of the commercial embodiment, and is hereby incorporated by reference. For clarity, the following discussion will deal more generally with the instrument disclosed in the manual, but will not recite all of the details therein.

The instrument of the present invention generally consists of a microprocessor-controlled six channel analog synthesizer, an electronic drum synthesizer, an organ type keyboard, a calculator type key pad for command entry and an audio system having a plurality of discrete audio channels.

A plurality of musical lines or "components" of the accompaniment exist as independent processes executed by a microprocessor in psuedo-concurrent fashion, without the burden of dealing with the complexities of mutual interactions. This is accomplished using a general purpose scheduling program known as a "kernel", consisting of a small number of basic routines or "primitives" which can be called by the processes to perform coordinating and timing functions. The primitives maintain the processes on a number of queues or "lists" until an appropriate timing or condition is satisfied. At that time, a process is placed on a "ready list" to be executed as soon as processor time becomes available. When the microprocessor is available, the process is "dispatched" to the "running state". It remains in the running state until it is "blocked" by an internal requirement to wait for a later time or for a specific condition. When a process has been blocked, it remains in that condition until it requires further servicing, regardless of the number of other tasks performed in the meantime. Only one process can be executed at a time, all the other processes being blocked by their presence on the wait lists of the kernel.

The use of the primitives of the kernel implicitly schedule the tasks of the accompaniment, which tasks need not be prescheduled in the manner of the prior art or addressed in sequential order. The processes are executed, one portion or "task" of a process at a time, such that the executions overlap to produce a coherent musical accompaniment. Since the processor is very fast and is not overly burdened in the present system, it appears to the listener as though the tasks are executed instantaneously upon being elevated to the ready list.

Each process is written independently of the other processes. Consequently, any one process is a relatively simple set of instructions which can be easily written, maintained and altered, if desired. In addition, the processes for the various lines of music can be varied independently, i.e., the process and variables for one line of music can be modified while maintaining the processes and variables of the other lines of music intact. This permits a wide variety of accompaniment patterns to be developed from a relatively small amount of code. It also enables a calculated randomization of the accompaniment, if desired, by randomly varying one or more lines of music independently.

Figure 5:
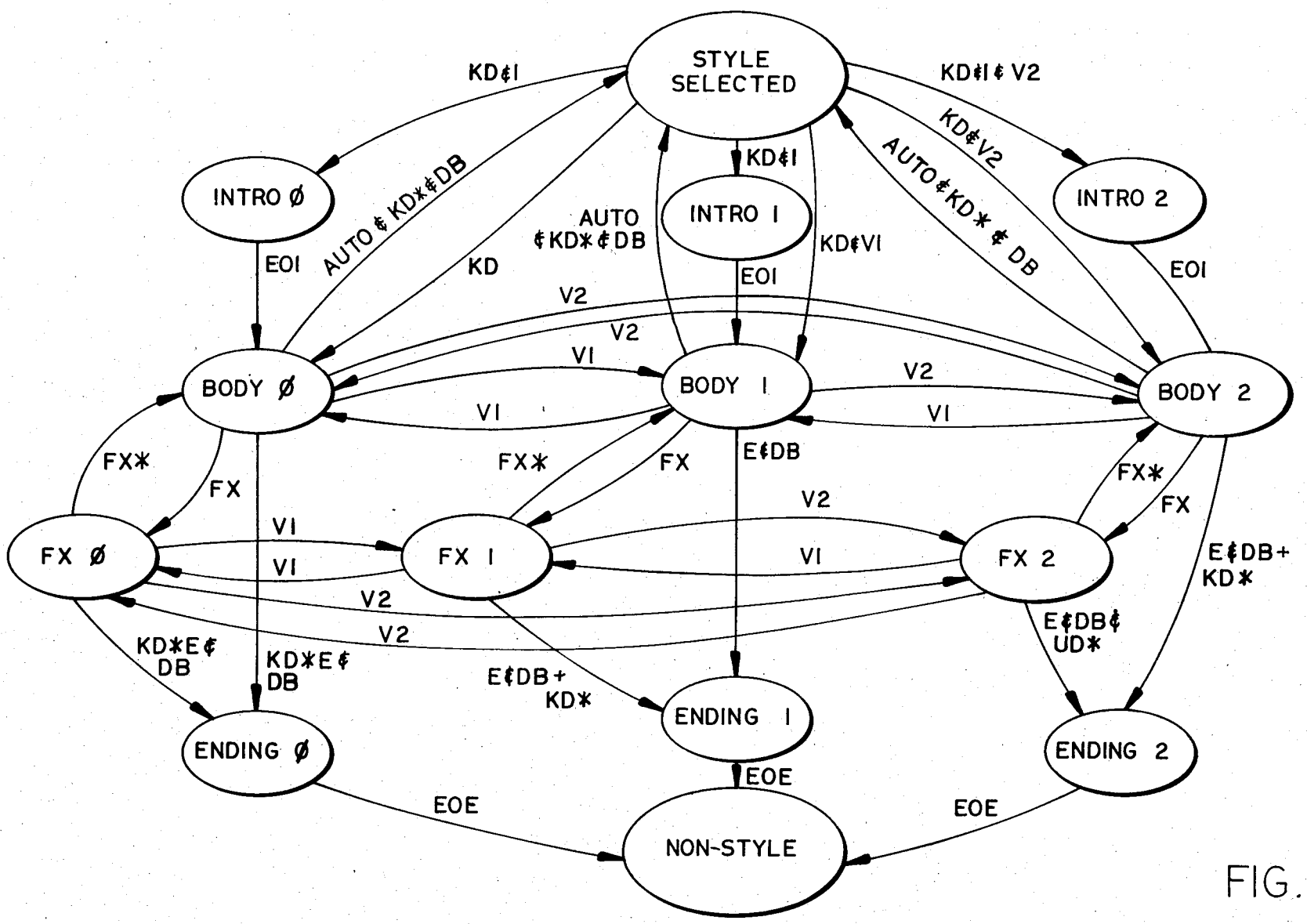
FIG. 5 is a more detailed diagram showing the "style selected", "style in progress" and "non style" states of FIG. 4.

The instrument of the present invention is capable of producing accompaniment in any of a plurality of different styles, and of operating within each style in a large number of "states" corresponding to different functions for which the accompaniment is designed and variations of the accompaniment for each function. FIG. 5 shows graphically the different states in which the system can operate. They include an introductory portion, a body portion, an ending portion and an "FX" portion, with each such portion being available in three variations. For example, accompaniment can be provided in any of the states designated "body 0", "body 1", or "body 2" by selecting an appropriate variation and depressing a harmony key of the instrument. Alternatively, one of the introductory portions can be invoked by choosing a variation and entering "I" on the control key pad. The instrument then plays a short musical phrase indicating that a rendition is about to begin. On completion of the introductory portion, a transition is made automatically to the state of the corresponding body portion. At the end of the desired rendition, transition can be made to the corresponding ending portion by pressing "E" on the control key pad and lifting the left hand off the harmony keyboard. The transition will take place at the next down beat.

During operation the system maintains a number of variables which are "global" in the sense that they are available to each independent process of the system. Among these is at least one "state variable" defining the state in which the instrument operates. Transition between states is accomplished by altering the state variable, which can be occur by manipulation of the control key pad, actuation of an FX switch, or permitting the introductory or FX portions of the accompaniment to run to completion.

Each "musical style" of the accompaniment is a separate framework characteristic of a particular type of music or manner of musical performance, as defined in Hall, et al, U.S. Pat. No. 4,433,601, the disclosure of which is hereby incorporated by reference. In the context of the present system, a style is defined by a set of rhythm templates, a set of instrument voices that might be invoked, and a set of controlling processes that have been started. Each template contains timing information, accent information and certain voicing changes, and different templates are provided for each component of the accompaniment. The template driven processes work on a common mechanism, whereby a template is selected, a musical event is performed at a time and with an accent or other special action specified in the template, and the process is blocked before the next musical event for a time period specified by the template.

The accompaniment provided by the system of the preferred embodiment of the present invention is responsive to both a harmony input and a solo input provided by a player. The components of the accompaniment are responsive to harmony input in essentially the manner described in U.S. Pat. No. 4,433,601. Namely, the machine assigns a chord type and root on the basis of player input and determines the harmony notes on that basis. The accompaniment notes are derived from the chord voice tables for each style. In some styles, a component of the accompaniment is derived from the harmonic relationship of the chord recognized by the system and the solo input of the player. This accompaniment may respond to "passing tones" which are not tones of the recognized chord, but when harmonized by the instrument add musical interest to a rendition. This method is discussed thoroughly in the above-identified copending U.S. patent application No. 274,606 of Hall, et al., the disclosure of which is hereby incorporated by reference.

The chord recognition data storage concepts of U.S. Pat. No. 4,433,601, and the harmonization method of application Ser. No. 274,606 are handled as pseudo-concurrent processes in the system of the present invention, and therefore can be incorporated wholesale into the system of the present invention without undue adaptation or programming changes. The kernel operates to combine the various accompaniment lines regardless of the details of each.

Of particular importance in the system of the present invention is the method by which a relatively small number of sound producing output channels are allocated between a larger number of virtual channels generated to implement a plurality of different components of musical accompaniment. Specifically, physical channels are allocated between virtual channels of a fill note component of the accompaniment and virtual channels of a different component of the accompaniment, either by giving one component of the accompaniment priority over the other or by giving the components equal priority and allocating channels on a first-come-first-served basis.

The present invention provides the minimum amount of sound producing hardware by allowing internal software to assign resources on an as-needed basis. Whereas most conventional organs provide output hardware sufficient to produce the worst case (largest) combination of notes which might be sounded, the preferred embodiment of the present invention provides channels only for the likely combination of notes. This suffices very well because the missing notes are chosen to be the weakest or least dominant of the notes in the accompaniment and thus, the absence of these notes tends to be masked by the remainder of the accompaniment. This is particularly true where one of the remaining notes is voiced as a solo instrument. In addition, the worst case combination of notes probably tends to sound cluttered and would not be desirable in any case. When resources run short, a prioritization is made to determine which virtual channels are given access to the resources.

System Hardware

The system hardware, shown in FIG. 1, comprises a microprocessor-controlled keyboard instrument 10, an analog synthesizer 12 and a ditigal control circuit 14. The keyboard instrument 10 receives style, harmony and melody information from a player and derives suitable accompaniment by executing a number of accompaniment processes in a pseudo-concurrent manner. The keyboard instrument 10 acts through the analog synthesizer 12 to produce a sequence of starting tones which are controlled by the digital control circuit 14 to produce an audio output which simulates the sound of a plurality of musical instruments.

The keyboard instrument 10 comprises a microprocessor 16, a RAM 18, a ROM 20, a plurality of player input devices 22 and a miscellaneous control circuit 24. The microprocessor 16 acts in response to an interrupt timer 26 and communicates with the other elements of the keyboard instrument 10 through a combined address and data bus 28.

The microprocessor 16 is preferably a 16-bit (internal) microprocessor with an 8-bit (external) data bus to control the processing of data. A suitable microprocessor is Model No. 8088 manufactured by the Intel Corporation. The timer 26 provides a five-megahertz system clock for the microprocessor and a buffered 3.75-megahertz clock for use by the analog synthesizer. The ROM 20 preferably has at least 24,000 bytes of program memory for system control, providing a sequence of instructions for the microprocessor to follow. When the microprocessor is reset, the address lines are present to a specific address in memory 16 bytes below the top of the memory space. Program execution begins at this space. Within the 16-byte space are instructions initializing the system and directing the microprocessor to the beginning of the system program. The RAM 18 has at least 2,000 bytes of random access read-write memory for temporary storage of data being manipulated and processed by the microprocessor.

Within the miscellaneous control 24 is a programmable interrupt controller of conventional design which signals the microprocessor when service is required by one or more devices connected to its input. The interrupt control, which may take the form of Intel Model No. 8259, takes over control of the processor whenever a hardware interrupt is signalled at one of its inputs. This forces execution of an interrupt service routine, which causes the input to be serviced while retaining the address to which the processor must return when control is given back to it. In addition to responding to hardware interrupts activated by the player-input devices 22, the interrupt controller is used to implement global counters, such as the real time counter of the microprocessor.

The player input devices 22 comprise a right-hand keyboard 30, a left-hand keyboard 32, a control keypad 34 and an FX switch 36 and a display 37. The keyboards 30 and 32 may be different portions of a single continuous keyboard designed for melody and harmony input, respectively, or can be separate right and left hand keyboards in the nature of the upper and lower keyboards of a conventional organ. In either case, the two keyboard portions provide conventional means for playing the instrument according to known techniques of musicianship, and for the application of data to the processing system. Alternatively, harmony may be selected by means of a conventional button-type chord selector.

The keys of the keyboards 30 and 32 are of conventional design, as disclosed in copending application Ser. No. 274,606. Each key has a separate key switch closure for applying an input signal to the microprocessor 16 when the key is depressed. The harmony data input via the left hand keyboard 32 is processed in the manner disclosed in U.S. Pat. No. 4,433,601 to derive a chord type and root. The musical basis for recognition of chord type and root are also discussed at pages 6 and 8 of the Lowrey Service Manual identified above. Page 6 contains an illustrative chord recognition chart and page 8 contains specific musical examples of chord recognition. The melody input from the right hand keyboard 30 is processed by the microprocessor 16 in the manner described in pending U.S. patent application Ser. No. 274,606.

The recognized type and root of the harmony input, as well as the detected melody input, are stored as global variables accessible to any of the processes executed by the microprocessor 16. This minimizes data storage requirements and enables the various processes of the instrument to produce compatible musical outputs.

Figure 2:
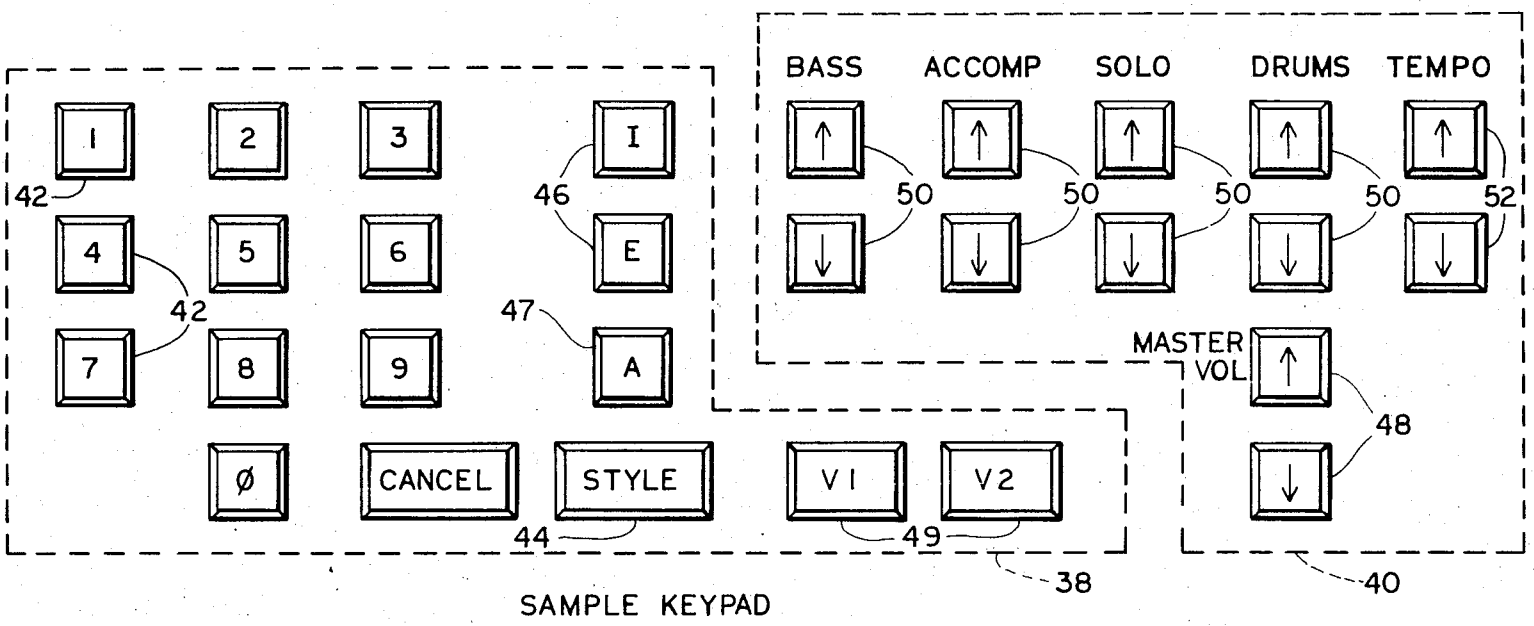
FIG. 2 is a representation of the input keypad of the musical instrument illustrated in FIG. 1.

The control key pad 34, which is illustrated in detail in FIG. 2, comprises a plurality of switch closures arranged as a first portion 38 and a second portion 40. The switch closures of the first portion 38 are similar to those of a calculator type key pad and include buttons 42 bearing ten numerical digits (1 through 0), a "style" button 44, buttons 46 for implementing introductory ("I") and ending ("E") portions of the accompaniment, an "autostop" button 47, and buttons 49 for implementing two alternative variations of the accompaniment, respectively. The second portion 40 of the key pad has a pair of switch closures 48 for controlling the master volume and three other pairs of switch closures 50 for controlling the base, accompaniment, solo and drum volumes, respectively. Another pair of switch closures 52 controls a variation of tempo from that preprogrammed for the style. Each pair of switch closures contains one closure for increasing and one closure for decreasing the parameter being controlled. The closures are scanned approximately once every two milliseconds and the push buttons of the key pad portion 38 are scanned approximately once every forty milliseconds. In this process, the microprocessor puts out a scanning address on one of its ports and checks the test input for a key switch or push button switch closure. If the test input pin is high, a counter internal to the microprocessor is decremented and the next switch is checked. The microprocessor checks all the switches during each cycle but will stop scanning the pushbuttons as soon as it finds a switch depressed. Internal parameters are changed in response to closure of a switch according to a software algorithm. In the case of the switch closures of the second portion 40, software counters are incremented according to the length of time that the corresponding switch is closed. Thus, a volume or the tempo can be increased or decreased by depressing the appropriate one of the switch closures for a specific period of time. The amount by which the parameter is altered is proportional to the time the switch is closed, permitting control by the player within a preselected range.

The FX switch 36 of FIG. 1 is a bar extending across the front of the keyboard instrument and coupled to a touch sensitive electronic switch connected to a high frequency RC network. When the FX bar is touched, the capacitive reactance of the bar is lowered, increasing the time constant of the network. During the scanning sequence, the microprocessor detects if the FX bar has been touched and takes appropriate The display 37 is an LCD or other suitable device for displaying style and other information during machine operation.

The analog synthesizer 12 comprises a hex pulse generator 54 driving pitched output channels 56 through 66, and a drum synthesizer 68 and noise generator 70 driving a precussion output channel 72.

A high-frequency clock signal is applied to the input of the hex pulse generator by the interrupt timer 26. The generator comprises six 16-bit divider channels, each capable of dividing the input frequency by an integer up to 65,535. Four bytes of data are required to program each divider. The first byte written to a divider is applied to the address register within the generator to select the low divisor register of one of the dividers. The next byte of data is written into the selected low divisor register, and the third byte selects the high divisor register of that divider. The fourth byte of data writes the eight most significant bits into the high divisor register.

The output of each divider is a tone pulse rich in harmonics which has a pitch and waveform chosen to correspond to a preselected musical tone and voice. The output channels produce the desired output tones of an organ by a subtractive synthesis method, using a voltage-controlled filter 74 and a voltage-controlled amplifier 76 to establish the frequency and amplitude envelopes of the output tone. The filters 74 and amplifiers 76 are controlled by voltages Ei and $E_{i+1}$, respectively, produced by the keyboard instrument 10 in combination with the digital control circuit 14. Each voltage controlled filter is a voltage multiplier circuit responsive to an input voltage $E_i$ to modify the harmonic spectrum of a tone produced by the hex pulse generator. The transfer function of the voltage-controlled filter has a preselected frequency envelope. The output of the filter passes to the corresponding voltage-controlled amplifier 76 which applies an amplitude envelope in accordance with the signal $E_{i+1}$. The filtered and amplitude-controlled signal then passes through a second voltage-controlled amplifier 78 which sets the overall channel gain. Finally, the signal is amplified by a power amplification circuit 80 and sounded through a speaker 82. Each of the pitched output channels 56–66 is independently and dynamically adjustable through the keyboard instrument 10 and the digital control 14 to produce an output tone having a preselected frequency spectrum envelope, amplitude envelope and overall gain. The channels are rapidly reprogrammed between the desired tones by updating the data in the registers of the hex pulse generator 54 and varying the control voltages $E_i$ and $E_{i+1}$.

In the percussion output channel 72, the drum set 68 is a conventional programmable synthesizer able to generate a wide variety of drum sounds in response to a drum clock signal. The drum clock signal is provided by the microprocessor 16 and the interrupt timer 26 to produce a desired drum output frequency along a conductor 84. The noise generator 70, on the other hand, generates a pulse which varies randomly in amplitude and frequency. The output from the noise generator 70 corresponds to the frequencies of non-drum percussion instruments usually included in a drum set, such as cymbals. The tone pulses are applied to a voltage-controlled filter 86 and a voltage-controlled amplifier 88 which apply frequency and amplitude envelopes to the pulses according to signals E13 and E14, respectively. Control is accomplished in a dynamic manner by the two control signals, which are produced by the keyboard instrument 10 and the digital control circuit 14. The output of the voltage-controlled amplifier 88 and the drum tone on the conductor 84 are applied to a voltage controlled amplifier 90 which sets the overall channel gain. The output from the voltage-controlled amplifier 90 is sounded through a power amplifier 92 and a speaker 94.

The digital control circuit 14 comprises a selector 96 having a plurality of low-pass filters 98 at the output thereof. As described fully in the Lowrey Service Manual incorporated by reference above, the selector 96 comprises a digital-to-analog converter, an analog multiplexer and a series of sample and hold buffers for each of the low-pass filters 98. Channel address information from the RAM 18 is applied to the input of the selector 96 by the microprocessor 16 to cause the multiplexer in the selector to pass corresponding analog control information to the different low-pass filters 98. Before multiplexing takes place, all of the digital control information is transformed to desired analog information by the single digital-to-analog converter. The analog voltage levels applied to each of the sample and hold buffers is refreshed every 100 milliseconds by the microprocessor. The multiplexer is enabled for 20 microseconds per sample and hold buffer. The voltage applied to each buffer maintains a charge on a capacitor at a constant level.

The output of the selector 96 contains frequency and amplitude envelope information ($E_i$ and $E_{i+1}$) for application to the voltage-controlled filters and voltage-controlled amplifiers of the six pitched channels and the percussion output channel of the analog synthesizer 12. Each channel is individually programmable by the microprocessor to produce discrete acoustic outputs corresponding to different portions of a musical accompaniment. The channels are discrete from tone synthesis to sound production, and thus have zero intermodulation distortion. The central microprocessor control provides rapid operation and great flexibility in the production of output tones.

System Software

Figure 3:
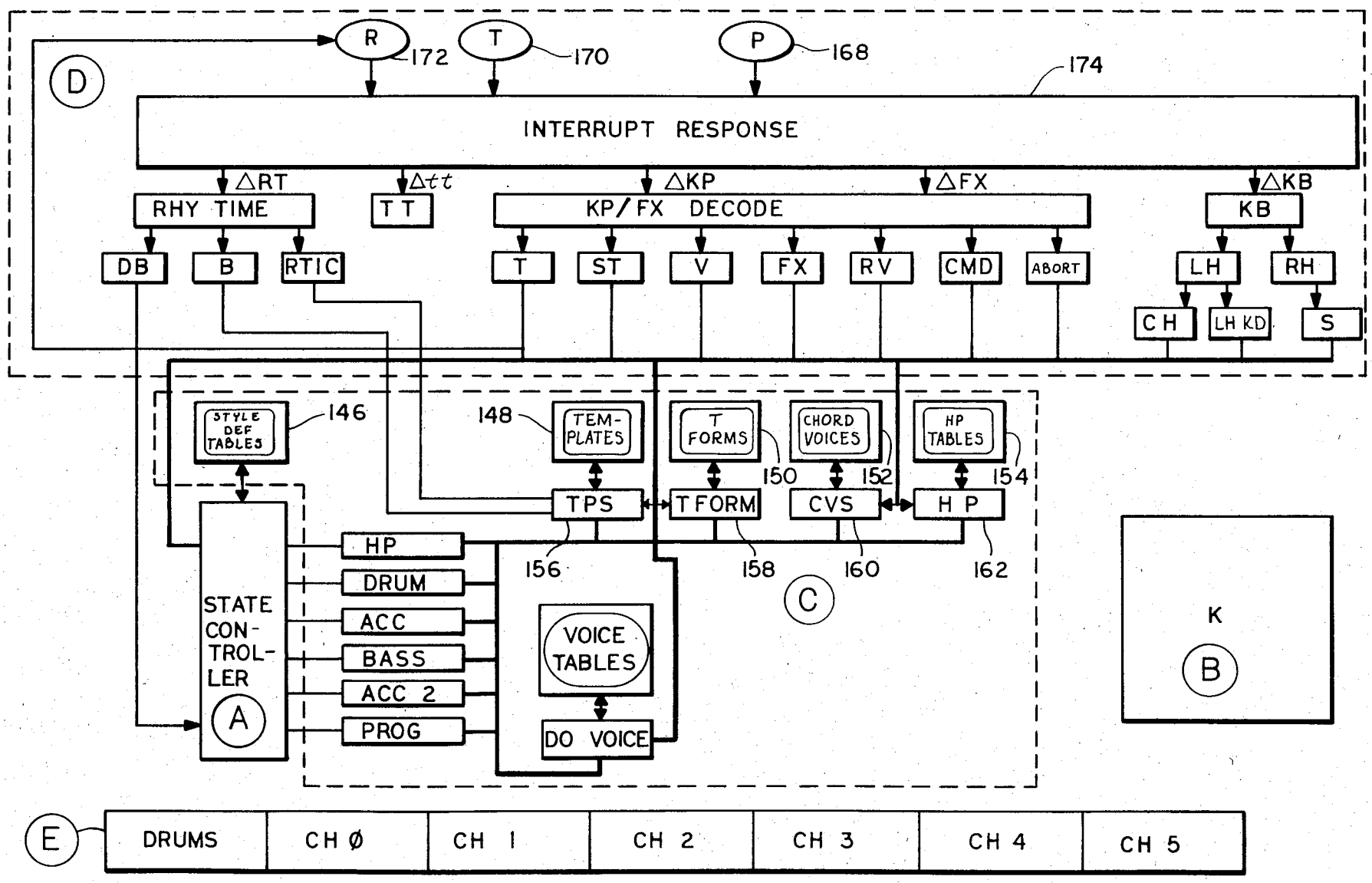
FIG. 3 is a generalized block diagram showing the organization of the software associated with the instrument of FIG. 1.

The software of the present invention is illustrated schematically in FIG. 3, in which it is segregated into the following functional categories:

A: State Controller
B: Organizational and Scheduling Software (Kernel)
C: Software Generating Accompaniment Data for Each Style
D: Input Rsponsive Software
E: Software Controlling Output Hardware The system operates in a state controlled by the software of category A, such that the plurality of processes of C are performed in an order and according to a schedule determined by the software of category B. The data generated by the software of category C depends upon the style, state and musical information input with the aid of software of category D, producing output processed by the software of category E. With this background of interaction, the software subsections will be discussed below to provide a more complete understanding of the system and method of the present invention.

A. State Controller

The state controller software maintains and updates a plurality of global variables which define the style and state in which the system operates. As illustrate in FIG. 4, a simplified overall state diagram of the system, the instrument is temporarily in the "UNINITIALIZED" state when the power is switched on, but immediately goes through an initialization procedure to place it in the "NON-STYLE" state. The initialization procedure will be discussed in more detail below. Upon entry of an appropriate style number and depression of the "style" key 44 of the key pad 34, the global variable denoting style is assigned a value corresponding to the indicated style. This switches the system to the "STYLE SELECTED" state. However, the instrument remains silent until the key is depressed on the left hand keyboard 32, whereupon the system enters the broad "STYLE-IN-PROGRESS" state. In the STYLE-IN-PROGRESS state, the instrument produces automatic accompaniment in accordance with keyboard input. A style continues in this state until either the AUTO or ENDING buttons of the key pad are selected. If the "E" button is depressed, the accompaniment continues until the first downbeat for which no harmony is depressed, whereupon it undergoes either a transition to the NON-STYLE state by way of a normal ending, or switches back to the STYLE-SELECTED state if the AUTO button 47 of the key pad has been depressed. The STYLE-SELECTED and STYLE-IN-PROGRESS states can be aborted by pressing the "zero" and "style" buttons of the key pad, thus switching the instrument to the NON-STYLE state.

The STYLE-IN-PROGRESS state is shown in more detail in the state diagram of FIG. 5. The STYLE-IN-PROGRESS state is actually broken up into 12 discrete sub-states corresponding to "INTRO", "BODY", "ENDING" and "FX" states for each of three variations of a selected style. If no variation is indicated by depression of one of the two variation buttons 49 of the key pad, the system operates by default in the variation designated by the suffix "0".

From the STYLE-SELECTED state, the system can be switched to the appropriate BODY state by a keydown (KD) of the harmony keyboard, or can be placed in the appropriate INTRO state by a keydown after depression of the "I" button of the key pad 34. From the BODY state, the system can be switched to the corresponding FX state by activating the FX switch 36 and continuing to hold it, and can be placed back in the appropriate BODY state by waiting for the FX portion of the accompaniment to end after releasing the FX bar. When a downbeat occurs in the BODY state and none of the harmony keys are depressed, the system will pass to the STYLE SELECTED state if it is in the AUTO mode, or pass to the corresponding ENDING state if the pushbutton "E" of the keypad 34 has been depressed. Once in the ENDING state, the system passes automatically to the NON STYLE state upon completion of the ending portion.

As discussed above, the system operates by default in the "0" variation state if neither of the variation pushbuttons has been depressed. If one of the pushbuttons has been depressed, the states are changed accordingly. The system can be switched from the BODY state of one variation to the corresponding state of either of the other variations by depressing the appropriate variation pushbutton. If the system is operating by default in the state BODY "0", the transition to the BODY 1 or BODY 2 state is made by depressing the appropriate variation pushbutton. The system is switched to the BODY 1 state by depressing the "V1" pushbutton, or to the BODY 2 state by depressing the pushbutton "V2". Similarly, switching between the BODY 1 and BODY 2 states is accomplished by depressing different variation pushbuttons. The transition from the BODY 1 state to the BODY 0 state is accomplished by pushing the pushbutton "V1". Thus, the pushbutton "V1" switches the system between the body states of the "zero" and the "1" variations in a toggling action.

Referring to the abbreviations on the drawing of FIG. 5, "EOI" and "EOE" denote the end of the introductory portion and the end of the ending portion, respectively. These conditions cause automatic transitions between states. Other conditions or events affecting transition are keydown (KD) and the Values V1 and V2. KD is a flag causing transition to take place, while "I", "E" and "AUTO" are each bistable state variables which tell the system to make a transition. Similarly, V1 and V2 are mutually exclusive bistable variables which direct the system to the proper state. Each state variable is a global variable matintained by the State Controller A, and is accessible throughout the system.

Changes between states are implemented by loading another set of global variables with addresses of chord, voice and template information relating to a particular style. This information is derived from a style definition table for the particular style, a sample of which is given in Table 1 for the "Jazz Guitar" style.

For a particular selected style, each state of FIG. 5 other than the STYLE and NON-STYLE states represents a different combination of accompaniment processes, a different set of templates, and possibly different chord and melody voicings. As developed more fully below, the processes listed in the style definition table are executed concurrently by the microprocessor 16, and a different rhythm template is provided for each component of music. All of the templates work on a common mechanism. They contain timing information, and may contain accent information and certain voicing changes.

B. Organizational and Scheduling Software (Kernel)

As discussed above, the accompaniment of the present invention is factored into a plurality of musical lines or components, each of which is implemented by its own accompaniment process. The processes are performed by the microprocessor in a pseudo-concurrent manner through the use of a general purpose scheduling program known as a "kernel".

Figure 6:
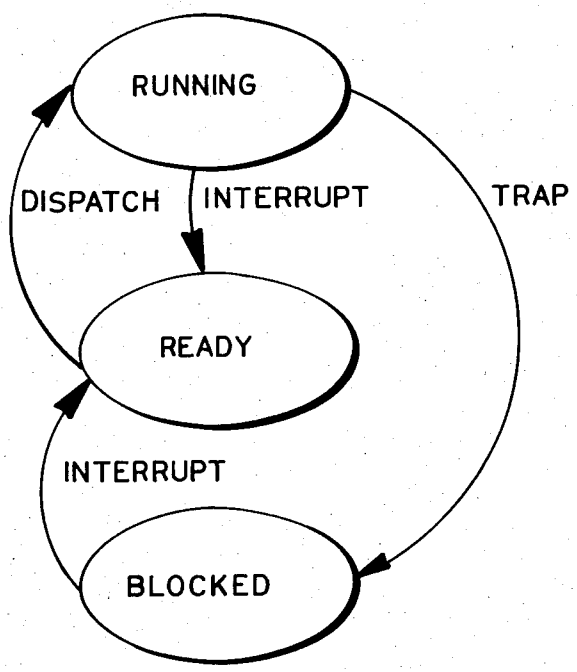
FIG. 6 is a graphical representation of three states in which each of the independently store accompaniment processes can exist.

The different states in which an accompaniment process can exist are illustrated in the state diagram of FIG. 6 as "running", "ready" and "blocked". The process exists in one of these three states at any point in time, and only one of the processes can be running at any point in time. The remainder of the processes must either be blocked or ready. In the ready state, a process is due to be run but is waiting for avilability of the microprocessor. When the microprocessor becomes available, the process that first entered the ready state is dispatched to the running state to be immediately executed by the microprocessor. While in the running state, the process may be "interrupted" before it has completed a specified task, in which case it is moved to the ready condition, or may block itself by execution of a supervisory call or "trap". In the system of the present invention a process blocks itself when the next task to be performed must wait for a specific time, a specific point in the musical framework, or for a particular condition. It resides in the blocked state until an interrupt or a flag signals that the specified time has passed or that the required condition is true. It is then elevated to the ready state and is run at the first opportunity. Due to the speed of the microprocessor and the relatively low burden placed on it, processes are run almost immediately upon reaching the ready state. This maintains the integrity of the programmed timing of notes.

The principles of pseudo-concurrent processng or "multi-tasking" are described generally in Holt, Graham, Lazowska and Scott, *Structured Concurrent Programming with Operating System Applications,* Addison Wesley Publishing Company 1978. Another source discussing concurrent processing is McMinn, et al. "Silicon Operating System Standardizes Software", *Electronics, Sept.* 8, 1981. These publications discuss the concept of concurrency and are hereby incorporated by reference. The concepts discussed therein are applicable to the present disclosure, although they do not relate to its musical context or incorporate the two discrete timing schemes of the disclosure.

The kernel of the present invention consists of six basic routines or "primitives" which are called by the various processes to perform coordinating and timing functions. In combination, the functions serve to maintain the processes on a number of "wait lists" or "queues", elevate the processes to the ready state at the appropriate time, and dispatch the oldest process on the ready list to the running state. The six functions can be summarized as follows:

CWAIT—wait for a specific condition, then move the processes to ready list

RWAIT—wait for a rhythm (tempo) related time, then move the processes to ready list TWAIT—wait for a specific number of milliseconds, then move the process to ready list SIGNAL—force a condition "true"

START—move a given routine directly to the ready list

Figure 7A:
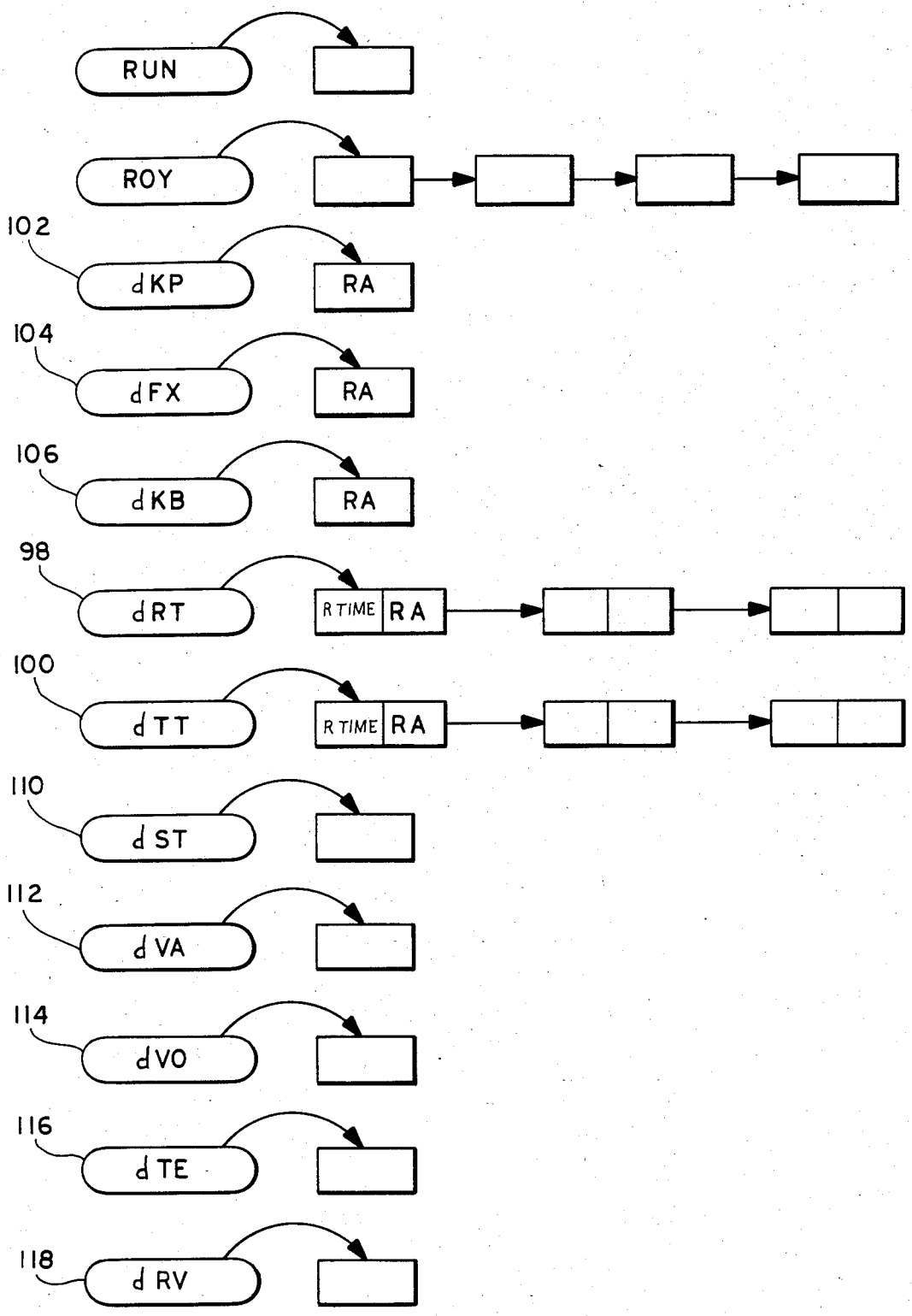
FIGS. 7*a* and 7*b* are schematic representations of the wait lists maintained by the kernel and the information thereon.
Figure 7B:
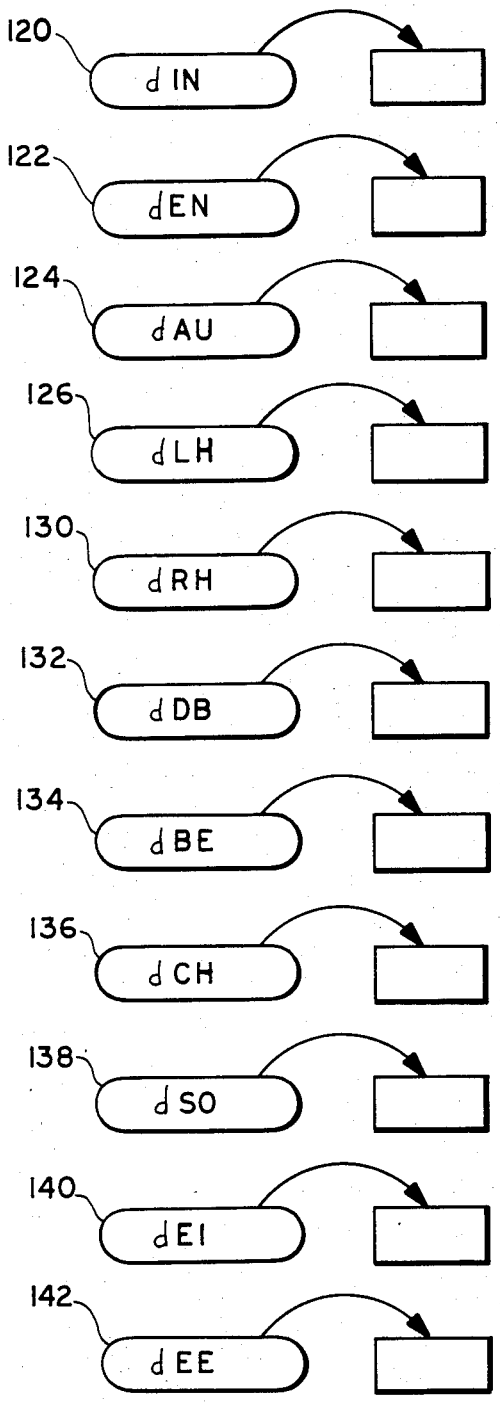

DISPATCH—move next ready process to the run state, or invoke an IDLE routine if the ready state is empty; also, move to ready list anything that has been signaled The operation of the kernel and its six primitives in maintaining and manipulating processes on the various wait lists can be in connection with FIG. 7, which is a schematic representation of the various lists and the information thereon. The flags for each of the lists have the following meanings:

dKP—any Keypad change
dFX—change in FX Bar
dKB—change on Keyboard (note added or note removed)
dRT—rhythm time expired
dTT—"true" time expired
dST—change of style
dVA—change of variation
dVO—change of volume
dTE—tempo change
dRV—revoice
dIN—intro selected
dEN—ending selected
dAV—auto stop selected
dLH—lefthand changed
dRH—righthand Keyboard change
dDB—down beat
dBE—beat change
dCH—new chord change
dSO—solo note change
dEI—end of intro
dEE—end of ending The run list (RUN) contains a single memory location bearing the address of whatever process is currently running in the processor, if any. The ready list (RDY) contains a sequence of memory locations containing addresses of processes where condition or time for performance has come to pass, or which have been moved to the RDY state by a START directive. The processes are dispatched from the RDY in the order that they are placed on the list, and an "IDLE" process is invoked when the RDY list is empty.

In addition to the RUN and RDY lists, the kernel maintains a list 98 ("dRT") of tasks to be performed at specific points in the musical composition of the accompaniment. This is the function of the RWAIT primitive. The number of pulses of a rhythm clock before the task is to be performed. The tasks are arranged in time order, such that the shortest time is first on the list, permitting the top address to be removed each time the number of rhythm clock pulses has elapsed. The RWAIT primitive performs a critical timing function in the production of automatic accompaniment. Its operation is based on the concept of "rhythm time" ("RT"), which is a specially derived timing scheme related to tempo.

The list 100 ("dTT") is maintained by the TWAIT primitive and is similar in structure to the dRT list 98. However, the parameter with which it is concerned is a specific amount of time, in milliseconds, rather than a number of rhythm clock pulses. Thus, the dTT list comprises a number of tasks listed in timed sequence, with the next task placed first on the list. The dTT list is triggered in accordance with a uniform clock pulse train developed by the interrupt timer 26 (FIG. 1) from the time the instrument is turned on to the time it is turned off. By contrast, the rhythm clock which triggers the dRT wait list is a separate pulse train having a rate which is characteristic of a selected style. The rhythm clock pulses occur as a multiple of the beat rate, and are preferably at least 12 times the beat rate. The number 12 is the least common multiple to all fractions of a beat normally encountered in musical compositions.

The use of two discrete timing schemes, one related to tempo (RT) and the other unrelated to tempo (TT), permits the microprocessor to operate at a rapid uniform rate while enabling the rhythm related musical events to be very accurately timed. This is true because the two times can each metered with a resolution best suited for that kind of time.

The remaining entries of FIG. 7 are lists of tasks to be performed when particular conditions come to pass and are maintained by the CWAIT primitive of the kernel. Lists 102 through 106 respond to hardware interrupts to place the address of each related task on the RDY list. In the case of list 102, an entry on the key pad 34 causes the flag "dKP" to be true and elevates the address 108 to the RDY list. This invokes the key pad handler routine, which is discussed in more detail below. The lists 104 and 106 operate in response to the FX switch 36 and to changes in the keyboards 30 and 32, respectively.

The entries 110 through 142 act in response to software flags denoting changes in a number of operating conditions of the instrument. These conditions range from the selected style (dST), variation (dVA) or volume (dVO) of the accompaniment to the passage of a downbeat (dDB). They operate in the same manner as the condition lists 102 through 106.

The wait lists of the kernel exist as an addressable data structure of the RAM 18. Each list has a corresponding address and comprises a plurality of memory locations with sequential index pointers designating their order on the list. When routines are placed on a list, the return addresses of the routines are placed at the memory locations, one address per location. In the cae of the rhythm time (dRT) and true time (dTT) wait lists, a time value denoting the number of rhythm or true clock pulses before a routine is to be implemented is stored along with the routine address. Each time a new task is placed on the DRT or dTT wait lists, the entries on the particular list are sorted according to time order, with the shortest time on top.

As discussed briefly above, the kernel consists of a number of basic routines or "primitives" which can be called by the independent accompaniment tasks to perform coordinating and timing functions. The six basic primitives are as follows:

CWAIT—wait for a specific condition
RWAIT—wait for a rhythm related time
TWAIT—wait for a specific number of milliseconds
SIGNAL—force a condition true
START—move a given routine directly to the ready state
DISPATCH-movement ready task to the run state or invoke an IDLE routine if the ready state is empty; also, move to ready anything that has been signalled.

Figure 21:
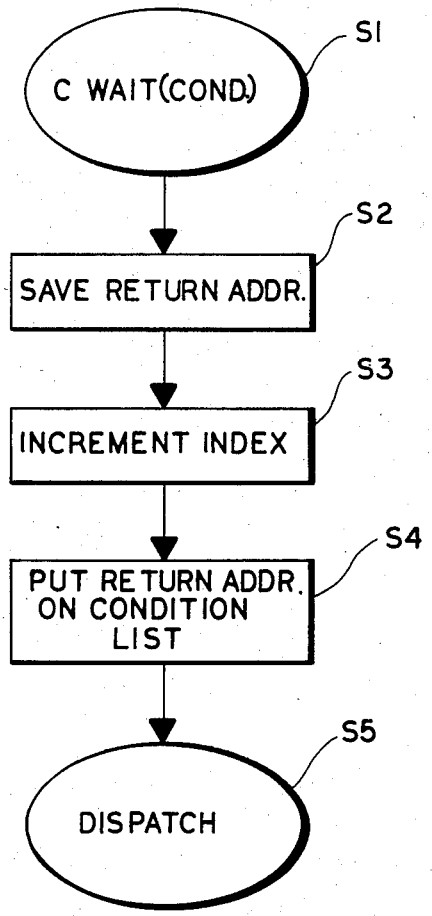
FIG. 21 is a simplified block diagram illustrating the CWAIT primitive of a system embodying the preferred embodiment of the present invention.

The primitives which make up the kernel are illustrated in flow chart form in FIGS. 21–26. FIG. 21 illustrates the primitive CWAIT(COND), primitive, where "COND" is the address of the condition for which the calling routine must wait. The primitive saves the return address of the calling routine (Step S2) and increments the index pointer for the specified condition so that it points at the next position on the condition list (Step S3). At Step S4, the primitive places the return address saved in Step S2 onto the selected condition list by writing it to the memory location pointed at by the index pointer. Step S5 terminates the CWAIT primitive by calling the DISPATCH primitive to dispatch a routine from the ready list to the running state. Thus, the CWAIT primitive is invoked to add the addresses of calling routines to the next available indexed location in the data structure making up a particular condition list. The lists serviced by the primitive of FIG. 21 are the lists 102–106 and 110–142 of FIG. 7.

Figure 22:
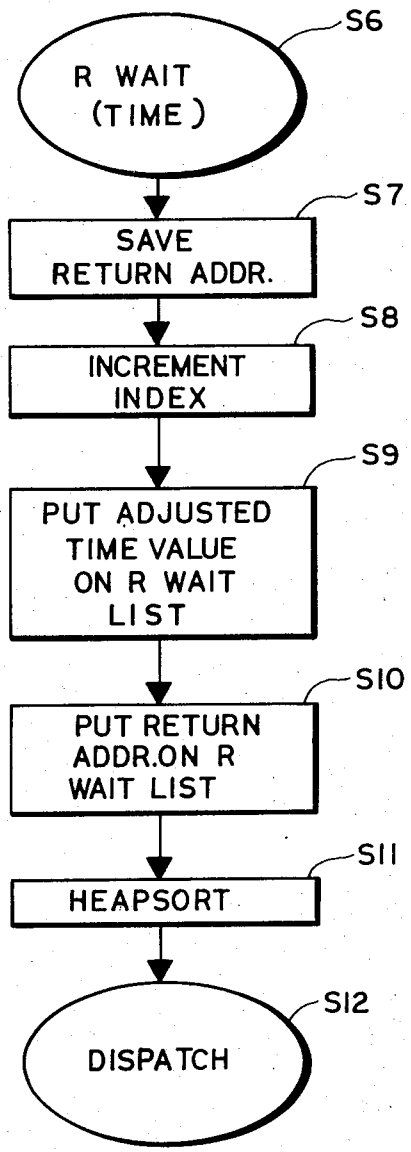
FIG. 22 is a simplified block diagram illustrating the RWAIT primitive of the preferred embodiment of the present invention.

The RWAIT routine, illustrated in FIG. 22, is invoked with regard to a particular routine by specifying a number of rhythm clock pulses after which the calling routine is to be executed. This number is the "offset time" which must be added to the current count of the rhythm clock to obtain an "adjusted rhythm time" at which the calling routine is to be performed. The RWAIT primitive is initiated by saving the return address of the calling routine for later use (S7) and incrementing the RWAIT pointer to point at the next position on the list. (S8).

The adjusted time value (current rhythm clock count plus offset and the return address of the calling routine are placed at the indexed memory location of the RWAIT list Step S9 and S10, respectively. Step 11 is a "heapsort" which sorts the wait list entries in time order such that the smallest time will be selected next. This concept is known in the computer field and is discussed at length in D. E. Knuth, *Art of Computer Programming-/Sorting and Searching*, pp. 145–149, 339–340 which are hereby incorporated by reference. S12 terminates the RWAIT primitive by calling the dispatch routine.

Figure 23:
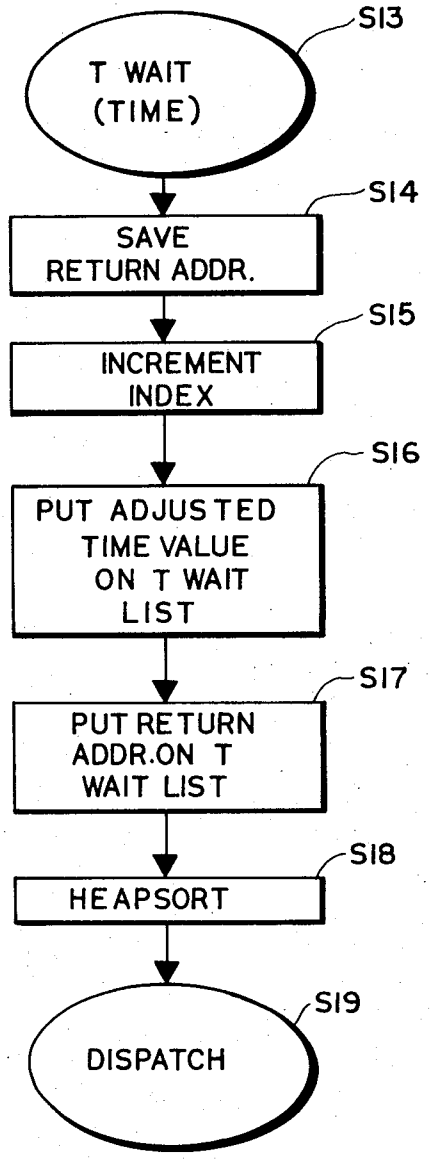
FIG. 23 is a simplified block diagram illustrating the TWAIT primitive of the preferred embodiment of the present invention.

The TWAIT primitive of FIG. 23 is identical to the RWAIT primitive of FIG. 22, except that the current and offset times used to determine when the calling routine is executed are true time values in milliseconds. The TT CLOCK keeps track of the current time and operates whenever the instrument is turned on. It represents the actual passage of time during operation, and is substantially unrelated to tempo. The entry point of the TWAIT routine is Step S13. The routine initially saves the return address of the calling routine (S14) and increments the index pointer of the TWAIT data structure to point to the next available position. The adjusted time value (current time plus offset time in milliseconds) and the return address of the calling routine are placed on the TWAIT list at the location pointed at by the index pointer (Steps S16 and S17 respectively). Step S18 is a heapsort and Step S19 calls the dispatching primitive.

The use of both an RWAIT and a TWAIT primitive provides an integrated scheme by which various tasks which are independently stored and maintained can be executed in a coordinated manner according to vastly different timing arrangements to produce musical accompaniment. The tasks on the TWAIT list are substantially tempo independent and thus are most efficiently handled by a constant, unvarying timing scheme. Examples of such tasks are definition of the attack and decay times of particular notes of the accompaniment, the time duration between notes of a simple strum, and the time alloted for the "chiff" of certain woodwind musical instruments. On the other hand, the timing of tasks on the RWAIT list is directly related to tempo. These tasks include the sounding of tones in the accompaniment and sustaining of tones in a rhythmic fashion.

Figure 24:
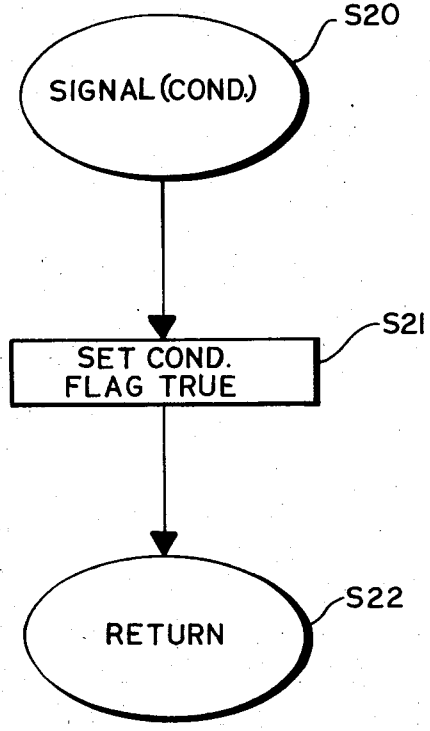
FIG. 24 is a simplified block diagram illustrating the SIGNAL(COND) primitive of the preferred embodiment of the present invention.

The SIGNAL primitive illustrated in FIG. 24 contains a single operative step, in which the flag for the condition being signaled is set "true" (S21). Control is then returned to the calling routine in step S22.

Figure 25:
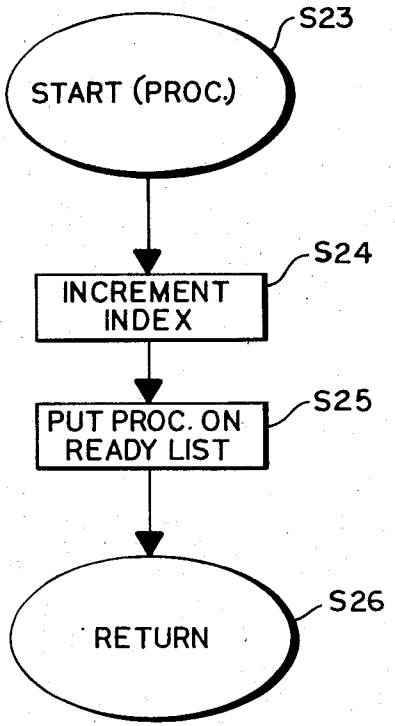
FIG. 25 is a simplified block diagram illustrating the START(PROC) primitive of the preferred embodiment of the present invention.

The START primitive of FIG. 25 is used to move a process directly to the ready list, bypassing the wait lists. The process increments the index of the ready list (Step S24) and then places the procedure on the ready list at the memory location pointed at by the index (Step S25). The primitive then returns control to the calling routine, (Step S26).

Figure 26:
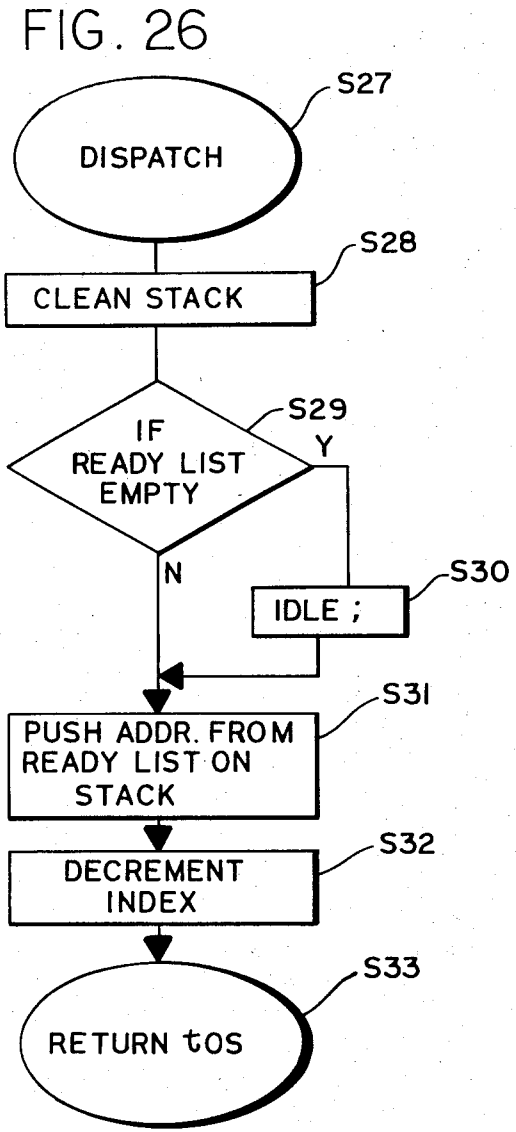
FIG. 26 is a simplified block diagram illustrating the DISPATCH primitive incorporated in the preferred embodiment of the present invention.

The DISPATCH primitive of FIG. 26 moves the oldest routine from the ready list to the running state. Immediately after the entry point (S27), the primitive cleans the stack by decrementing a stack pointer (Step S28). In effect, this removes the superfluous return address from the stack. At step S29, the ready list is examined to determine whether it is empty. If it is empty, the "IDLE" routine begins (S30). The IDLE routine continually examines the ready list to see if an address has appeared on it and moves to the ready list any process that has been signaled. Thus, when a flag of a particular condition list is forced "true" by the SIGNAL primitive, the contents of the condition list are elevated to the ready state. If the ready list is not empty at the time of the inquiry of Step S29, the top (oldest) address from the ready list is pushed onto the stack (Step S31) and the index of the ready list is decremented (Step S32). This "dispatches" the process which has been on the ready list the longest and adjusts the ready index for future operation. The same two steps (S31 and S32) are invoked after the idle routine, when an address appears on a ready list or a condition is signalled. Finally, the DISPATCH primitive returns to execute the address that was pushed onto on top of the stack (Step S33).

From the description above, it will be understood that the kernel operates, through its six primitives, to elevate the following to the ready state: any process on a condition list having a flag which is "true"; any process which has been "started" by another process; and any process which becomes due on either the RWAIT list or the TWAIT list. A dispatched process flows sequentially until it is blocked by an RWAIT, a TWAIT or a WAIT(COND) function. When that occurs, the process remains blocked until an appropriate condition or time, permitting other processes to be executed by the kernel. As a result, each process is stored separately and can be varied independently of the others.

C. Software Generating Accompaniment Data For Each Style

Referring again to FIG. 3, the software subsection C comprises a set of discrete accompaniment processes 144 for executing musical events as a number of different lines or components of the accompaniment. The processes 144 derive accompaniment data from style definition tables 146, rhythm templates 148, transform tables 150, chord voice tables 152, voice tables 153 and harmony plus tables 154. A number of additional routines are used to select and transform information from the list of tables. These include a template select routine (TPS) 156, a transform routine (158), a chord voice selection routine (160) and a harmony plus routine (162). Information derived from the templates and tables according to the appropriate subroutines are used in the processes 144 to provide note, timing and accent information for the production of the accompaniment lines. When integrated by the kernel, the different lines form a coherent musical accompaniment according to the style, variation and other state variables defined by the state controller (A).

The transform tables 150 and the chord voice tables 152 are preferably as described in the above-referenced co-pending application entitled "Harmony Note Selection Method", and the harmony plus tables 154 are similar to the augmentation tables disclosed in co-pending U.S. patent application Ser. No. 274,606 for "Method and Apparatus for Improved Automatic Harmonization", both of which documents have been incorporated herein by reference.

The routines 158, 160 and 162 for deriving information from such tables are also the same as corresponding routines of the referenced patent and patent application, except that they exist as independent processes performed through the kernel (B). Because the routines exist as discrete processes in the method of the present invention, the referenced disclosures are applicable in their entirety. Thus, the structures of the tables and the details of the routines will not be separately disclosed in detail herein. Rather, the following description will deal primarily with the tables, processes and other aspects which are peculiar to the system of the present invention and which would not be clear without such explanation.

The style definition tables 146 are in the form shown in Table 1 below, which is a sample table for the "Jazz Guitar" style. It was chosen for illustrative purposes because the jazz guitar style incorporates many of the more complicated accompaniment features of the present invention, such as rhythm templates and chord strum.

In the first column, the style definition table lists global variables defined by the tables. The second column lists the accompaniment processes in which the variables are used, and the remaining columns apply to the twelve "Style in Progress" states of FIG. 5. The last twelve columns of the table contain addresses, of the data structures containing variable information for each instrument state. Reading across the first row, the variable hp is implemented by the HP (harmony plus) process, which is the process of improved harmonization disclosed in copending U.S. patent application Ser. No. 274,606, which has been incorporated by reference herein. The process adds chord-like clusters of notes to augment a played melody. In the jazz guitar style, "harmony plus" augmentation is not provided in the style variations V0 and V1, but is provided in variation V2. Automatic harmonization in variation V2 is accomplished with block chords from a specific block chord table in memory. Thus, the entry in Table 1 for V2 and V2/FX is "PBLOCK". Looking at the second row of the table, the voice for the automatic harmonization notes is that of a solo accordian (saccrd). Dropping down to the variable entry "acc", the accompaniment variable is implemented by the chordal accompaniment process (ACC(jg)). The entries in the last twelve columns of the row give rhythm templates according to which chordal accompaniment is provided. The first nine columns, corresponding to the normal, FX and intro states for each of the three variations, contain the notation "jg-t" (jazz guitar template) The last three entries, corresponding to the "ending" states, bear the address "jge-t" (jazz guitar ending template). The next row indicates the voicing to be used in conjunction with this template. In each case, it is the accompaniment guitar ("aguitar").

The two rows, entitled "acc2" and "vacc2" correspond to a second line of accompaniment which is not used in the jazz guitar style. The row "prog" relates to a chord progression process (PROG) which is use in connection with the intro and ending states. The entry "cp5" denotes the fifth prescribed chord progression, while the designation "cp8" in the last three columns indicates the eighth chord progression.

As its name implies, the style definition table for a particular style defines the accompaniment style in terms of processes, voices and rhythm templates. Once a number of such voices, templates and processes have been provided in memory, styles can be generated largely by incorporation of existing data into new style definition tables. Because each line or component of music runs independently of the others, as coordinated by the kernel, the variables can be altered independently without interfering with each other or requiring laborious rescheduling of events.

Figure 8:
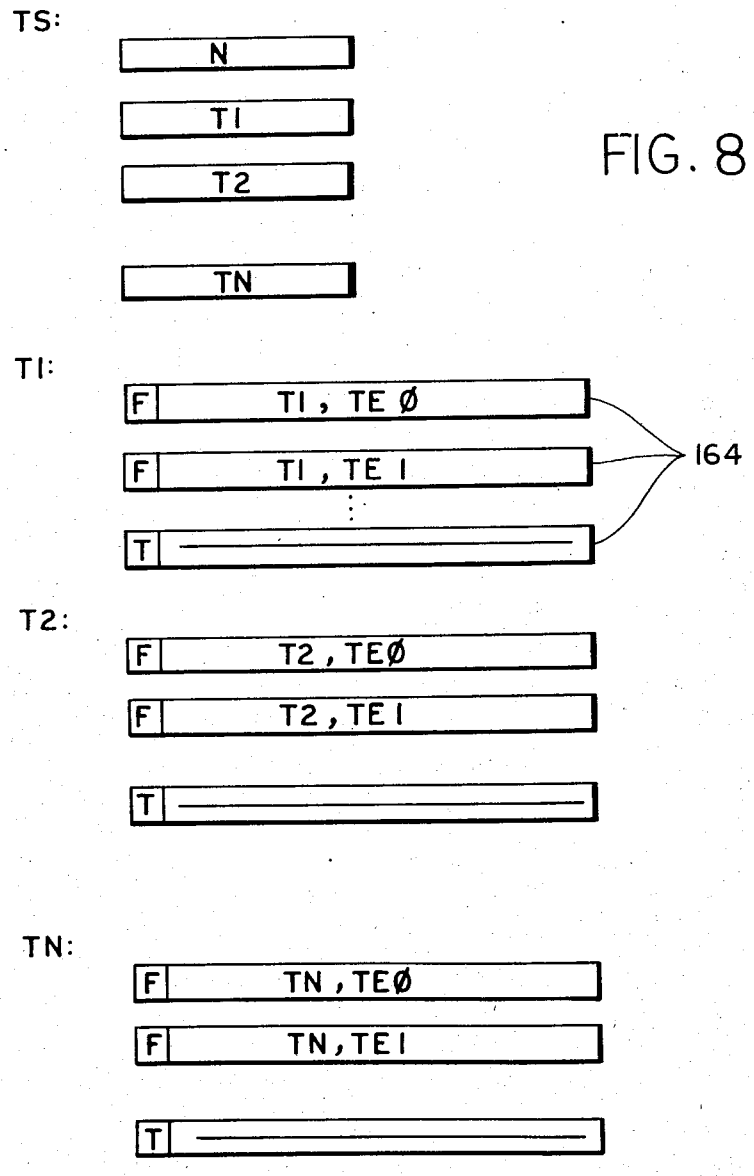
FIG. 8 is a generalized graphical representation of the data structures referred to as a set of templates in the preferred embodiment of the present invention.

The templates 148 of the software subsection C are data structures of the form illustrated in FIG. 8. The template structure (TS) includes N template pointers (T1, T2, T3 through TN) pointing to a like number of templates. Each template contains a discrete number of entries 164 made up of a flag 166 and three or four fields containing, for example, accent information tone duration or "time on" information, and "time till next" information. Each template containing musical information has a flag which is "false", while the last entry is designated by a flag which is "true". In the case of a separate melodic line such as a bass line, the associated templates can also contain note and octave information.

If more than one template is provided for a particular instance of process, style and instrument state, as is often the case, it is necessary to choose between the templates as the process is executed. In its simplest form the template selection routine 156 might involve choosing a new template in sequence each time a style and state of the instrument are chosen. However, a more sophisticated random selection is preferred in these circumstances.

TABLE 1

STYLE DEFINITION TABLE
(JAZZ GUITAR)

| GLOBAL VARIABLE | PROCESS | V0 | V1 | V2 | V0/ FX | V1/ FX | V2/ FX |
|---|---|---|---|---|---|---|---|
| hp | HP | * | * | PBLOCK | * | * | PBLOCK |
| vhp | | * | * | saccrd | * | * | saccrd |
| vsol | | sguitar | sflute | saccrd | sguitar | sflute | saccrd |
| drm | DRM | jgd_t | jgd_t | jgd_t | jgfxd_t | jgfxd_t | jgfxd_t |
| vdrm | | drumsl | drumsl | drumsl | drumsl | drumsl | drumsl |
| acc | ACC(jg) | jg_t | jg_t | jg_t | jg_t | jg_t | jg_t |
| vacc | | aguitar | aguitar | aguitar | aguitar | aguitar | aguitar |
| bas | BASS | jgb2_t | jgb4_t | jgb4_t | jgb2_t | jgb4_t | jgb4_t |
| vbas | | jzbass | jzbass | jzbass | jzbass | jzbass | jzbass |
| acc2 | | — | — | — | — | — | — |
| vacc2 | | — | — | — | — | — | — |
| prog | PROG | * | * | * | * | * | * |
| cv | | jcv4 | jcv4 | jcv4 | jcv4 | jcv4 | jcv4 |

| GLOBAL VARIABLE | PROCESS | V0/ INTRO | V1/ INTRO | V2/ INTRO | V0/ ENDING | V1/ ENDING | V2/ ENDING |
|---|---|---|---|---|---|---|---|
| hp | HP | * | * | * | * | * | * |
| vhp | | * | * | * | * | * | * |
| vsol | | sguitar | sflute | saccrd | sguitar | sflute | saccrd |
| drm | DRM | jgd_t | jgd_t | jgd_t | jged_t | jged_t | jged_t |
| vdrm | | drumsl | drumsl | drumsl | drumsl | drumsl | drumsl |
| acc | ACC(jg) | jg_t | jg_t | jg_t | jge_t | jge_t | jge_t |
| vacc | | aguitar | aguitar | aguitar | aguitar | aguitar | aguitar |
| bas | BASS | jgb4_t | jgb4_t | jgb4_t | jgeb_t | jgeb_t | jgeb_t |
| vbas | | jzbass | jzbass | jzbass | jzbass | jzbass | jzbass |
| acc2 | | — | — | — | — | — | — |
| vacc2 | | — | — | — | — | — | — |
| prog | PROG | cp5 | cp5 | cp5 | cp8 | cp8 | cp8 |
| cv | | jcv4 | jcv4 | jcv4 | jcv4 | jcv4 | jcv4 |

The chord voicing tables 152 and the chord voice selection routine 160 may, in some cases, take a form which is more sophisticated than that disclosed in U.S. Pat. No. 4,433,601 for Orchestral Accompaniment Techniques. The details of such tables and voice selection routine are illustrated in another application of applicants which is filed concurrently herewith and is entitled "Accompaniment Note Selection Method".

For purposes of illustration, the accompaniment processes of the jazz guitar style will be described below, as executed in a pseudo-concurrent manner with the aid of the software primitives discussed above.

The process implementing the chordal accompaniment line of the jazz guitar style (ACC(jg)) is illustrated in FIG. 14. The Step S34 is the entry point of the process, which is the guitar accompaniment part of the jazz guitar style. This process sounds chords in a jazz syncopated timing specified by a set of templates. Accents are controlled by changing the instrument number in a template. The first step, S35, randomly selects an accompaniment template. Alternatively, a simpler selection process can be provided or the number of templates can be limited to one.

The template select routine of step S35 initializes the chordal accompaniment template pointer to point to a valid template within a set of templates identified by the style definition table. If the pointer is pointing to the last template entry, as determined by a "true" value of the template flag 166, or if the FX bar has been activated, step S36 directs the processor to randomly select another template. If the FX bar has been activated, the template will be drawn from the FX columns of the style definition table. However, it should be noted that a change in variation (V0, V1 or V2) does not cause a new template to be selected until the old one is completed. If immediate response is desired for a variation, this can be accomplished by including the variation flag in the set of conditions for which we test. The routine then inquiries whether RND(4)=0 or the new chord flag is true. The function RND(4) is a well known function which randomly selects between the values 0, 1, 2 and 3. Functions of this nature are discussed at length in D. E. Knuth "The Art of Computer Programming-/Seminumerical Algorithms", Pages 9–34, 101–127, 155–157 and is herein incorporated by reference. Therefore, RND(4)=0 twenty-five percent of the time, causing selection of a new chord voicing at least that often. Step S40 again tests whether RND(4)=0, and if it does a new range is selected in step S42. Therefore, new chord voicing (S44) will be selected at least twenty-five percent of the time and a new range limitation on chord voices will be selected at least twenty-five percent of the time that chord voicing is changed. With regard to step S42, the selected range limitation takes the form of a note number (0–95) of the highest permissible note in the chord voicing. In step S44, notes are selected to make up the chord voicing. The selection of notes is influenced by several factors, including the chord root and chord type recognized by the instrument from player input, the range data supplied in step S42, and the set of applicable chord voicings from the style definition table (Table 1). The chord voicings for the jazz guitar style include chords containing extended chord tones and chords which are open voiced, as would be played on a guitar.

A preferred form of the steps S42 and S44 is disclosed in the above-referenced co-pending U.S. patent application and the "Accompaniment Note Selection Method", which is filed concurrently herewith. The disclosure of that application has, of course, been incorporated herein by reference.

The next step, S46, is encountered either directly from step S38, i.e., if RND(4) does not equal 0 and a new chord has not been selected, or after selecting a new chord voicing in step S44. It saves the note and voicing data generated in step S44 in appropriate global variables. Step S48 sets the "ontime" or duration of chordal accompaniment notes in a separate global variable designated "ONTIME". Step S50 starts the process of strumming the chordal accompaniment notes by invoking the "START" primitive of the Kernel to place the beginning address of the "Strum" routine (FIG. 15) on the ready list. This is shown in FIG. 14 as an entry into the kernel (a path passing to and from the kernel). The kernel is designated by a lower case "k" to show that the entry is merely an instantaneous one which does not block the chordal accompaniment routine. Thus, the Strum process runs independently of this routine and delays performed in the strum process are not additive to the execution time of the accompaniment routine.

Step S52 invokes the RWAIT primitive to block the chordal accompaniment process for the number of rhythm clock pulses or "tics" specified in the template entry. This returns control to the kernel (shown here as a capital "K") and performs the necessary timing function. Step S54 increments the template pointer to point at the next sequential entry and returns to the decision block S36. As discussed above, the last template entry is specifically marked by a flag which is "true" to indicate when a new template is needed. Selection of a new template is accomplished by steps S36 and S37.

Figure 15:
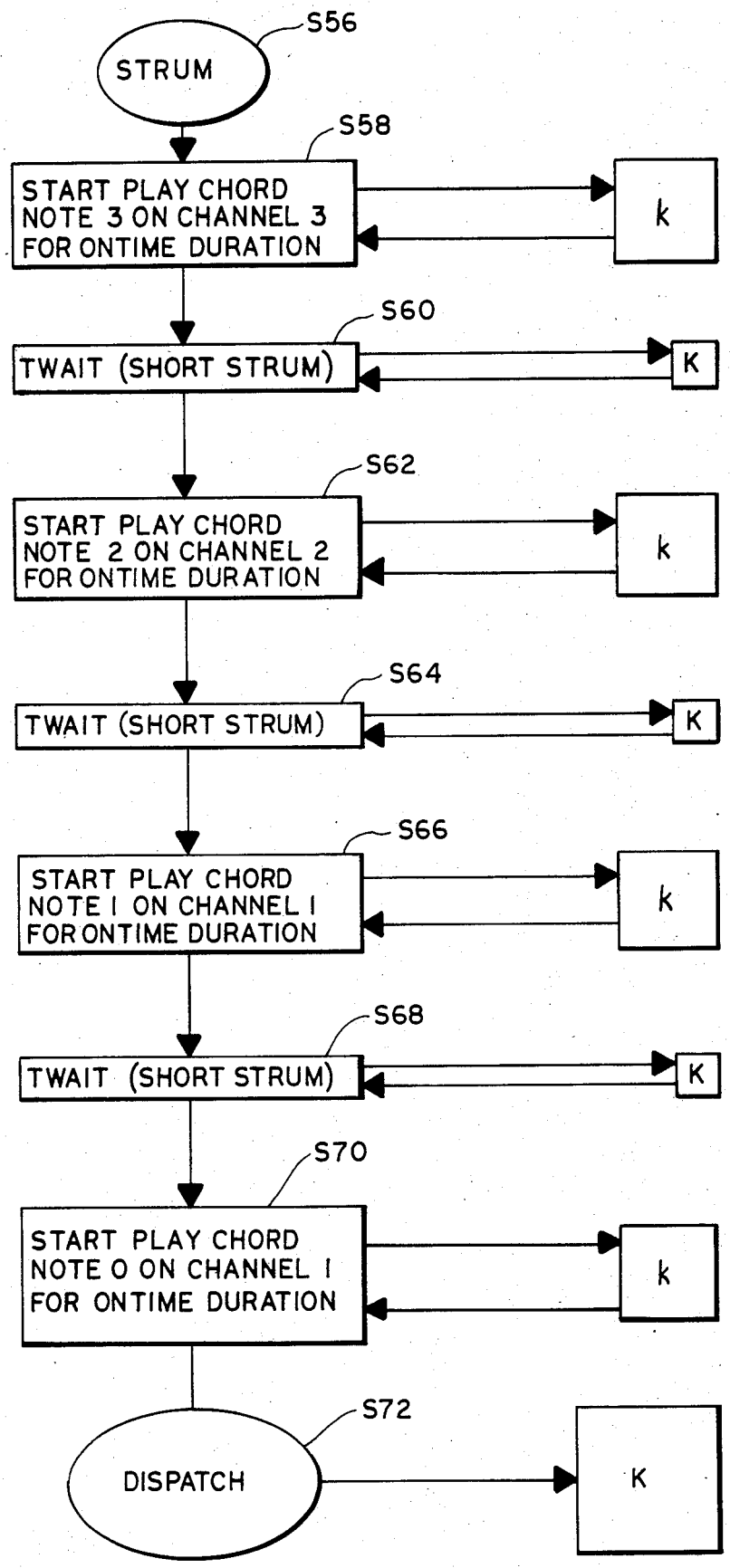
FIG. 15 is a simplified block diagram of a process for sounding a plurality of notes as a strum in the process of FIG. 14.

The Strum routine illustrated in FIG. 15 sequentially plays the four chordal accompaniment notes (chord notes 3, 2, 1 and 0) for the duration stored in the variable ONTIME. This is accomplished by steps S58, S62, S66 and S70. Each of these steps invokes the START primitive to place the beginning address of a routine designated "Play Note" (FIG. 12), and is represented as an entry into the kernel "k". Between these steps the routine is blocked by the TWAIT primitive (steps S60, S62 and S68) to space the notes apart in time by a duration "shortstrum". The duration shortstrum typically varies between 8 and 12 milliseconds, depending upon the requirements of the style, and for the jazz guitar style is approximately 8 milliseconds. It should also be noted that each chord of the strum is played upon a separate channel of the instrument. After the last note has been played, the routine is dispatched to the kernel at step S73.

Thus, the ACC(jg) process of FIG. 14 produces accompaniment according to randomly selected templates with new chord voicing selected at least twenty-five percent of the time and a new maximum range selected twenty-five percent of the time that chord voicing is changed.

Figure 16:
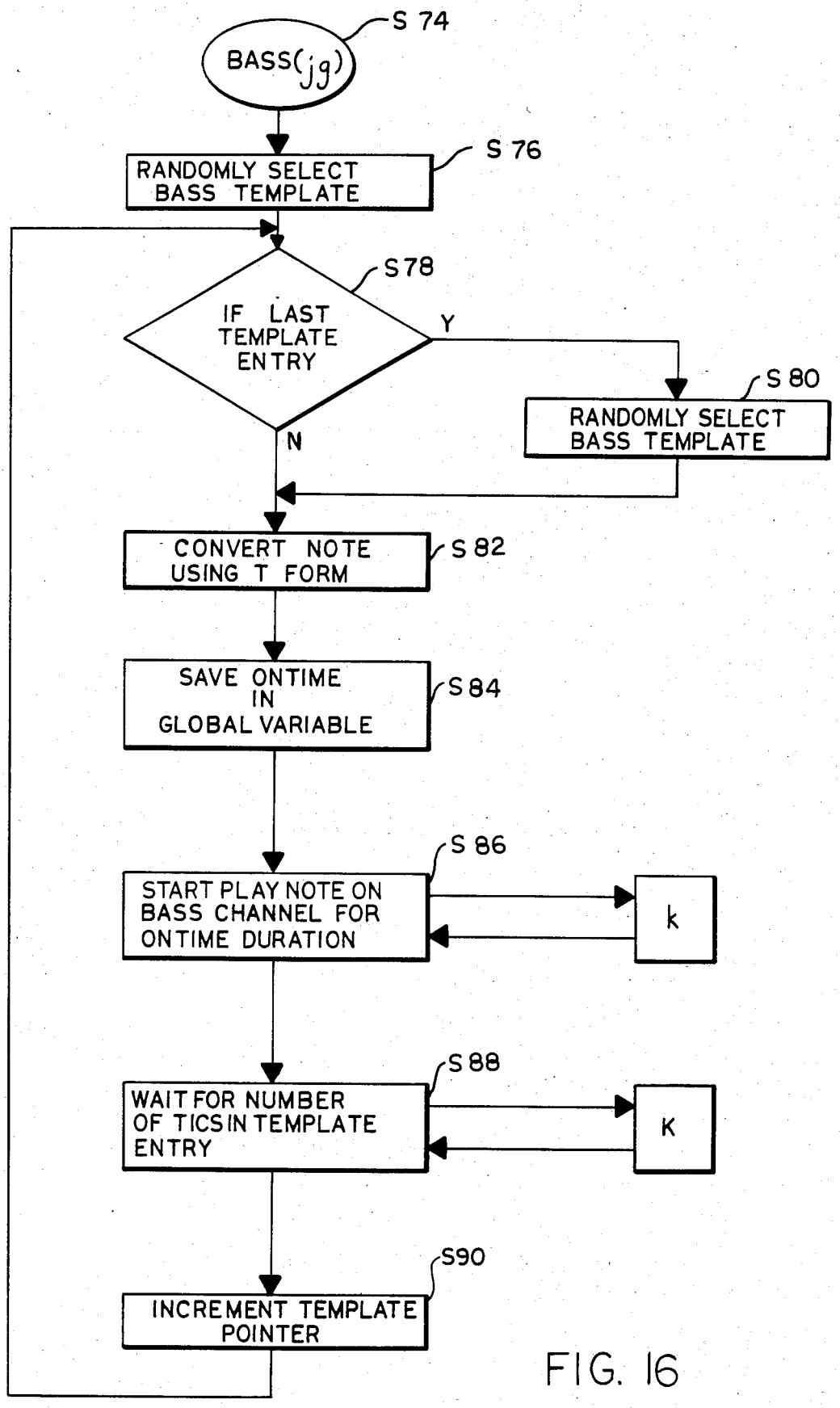
FIG. 16 is a simplified block diagram of a bass line accompaniment process for the jazz guitar style used in a system embodying a preferred form of the present invention.

The bass line process of the software entity C is illustrated in FIG. 16 as BASS (jg). The first step of the process (S76) is to randomly select a bass template. This step is identical to step S35 of the ACC(jg) process of FIG. 14, but utilizes a different set of bass templates which include note information. The templates are identified in the style definition table (Table 1). Step S78 inquires as to whether the template entry is the last entry, and if so a new template is selected in step S80. As discussed in connection with the chordal accompaniment templates, the last template entry is identified by a flag detected at step S78. Step S82 is reached either directly from step S78, if the template entry is not the last, or after a new bass template has been selected in step S80. Step S82 extracts the note information and voicing data from the template and stores it in global variables. In a preferred embodiment, step S82 converts the note information using the transform operation described in co-pending application for "Accompaniment Note Selection Method". That disclosure is hereby incorporated by reference and will not be treated in detail herein. In any event, a different method can be used and the manner of doing so is within the knowledge of those skilled in the art. The ontime duration for the stored note is then stored in the global variable ONTIME. Step S86 invokes the START primitive to place the address of the routine "Play Note" on the ready list so that the appropriate bass note will be played on the bass channel for the ontime duration. This is an instantaneous entry into the kernel to start the separate Play Note process, and the kernel is therefore represented as a lower case "k". Step S86 invokes the RWAIT primitive to block the bass line process for the number of rhythm pulses specified by the "time till next" portion of the template entry. Step S90 increments the template pointer to point at the next template entry and the process is continued at step S78 until the cycle is broken by the kernel. For example, the cycle is broken by the kernel when the instrument switches to the "Non Style" state of FIG. 5.

Although the BASS (jg) process is used in the preferred embodiment to produce a bass-like accompaniment, it can also be used to produce a melodic fill phase as might be performed by a guitar player or pianist.

Figure 17:
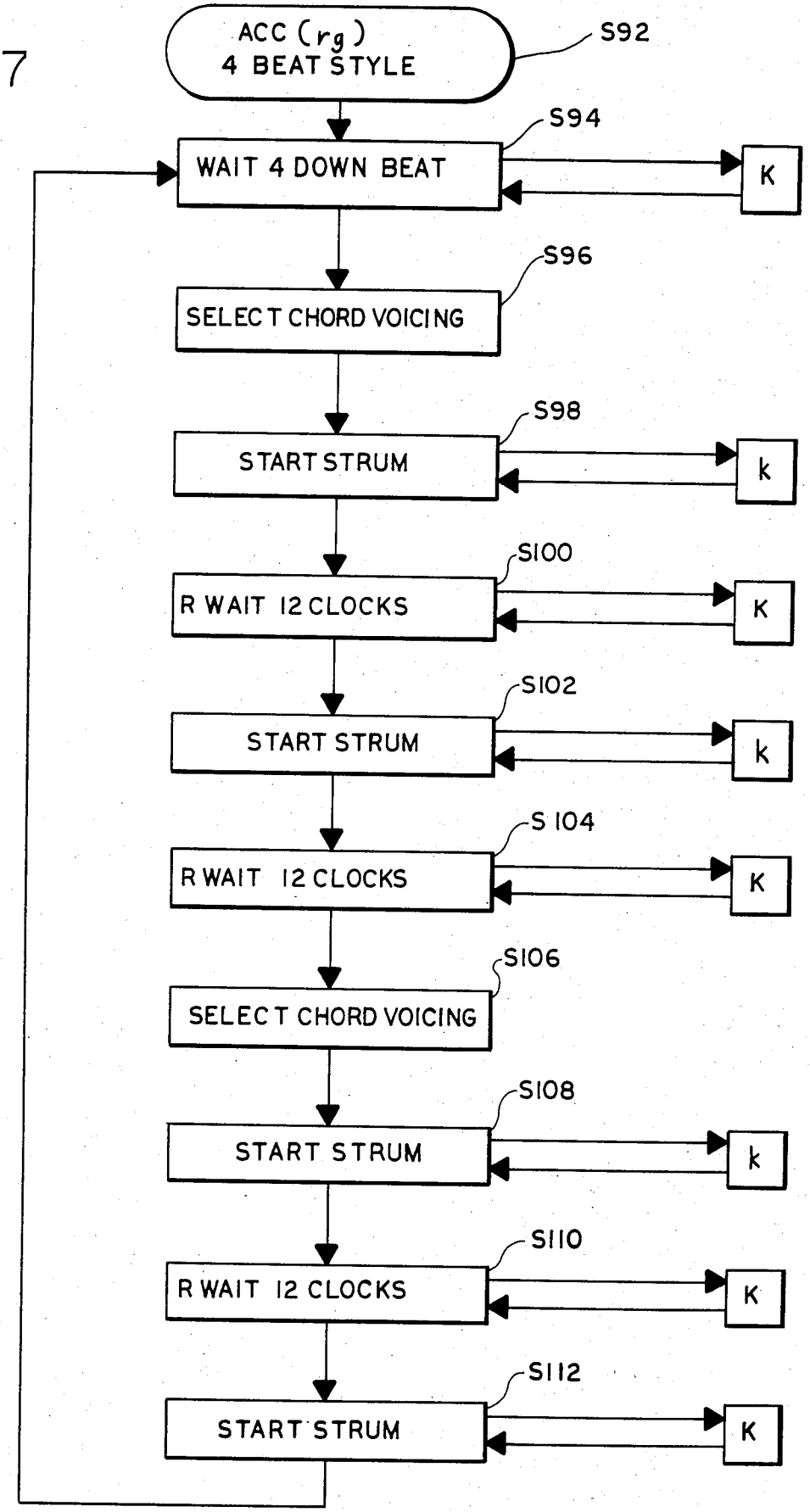
FIG. 17 is a simplified block diagram of a process for playing chordal accompaniment according to a rhythm guitar style in the system of the present invention.

An alternative style in which the chordal accompaniment tones are strummed is the "rhythm guitar style" (ACC(rg)) which is illustrated in FIG. 17. The process of FIG. 17, beginning with the entry point S92, represents a chordal accompaniment portion of the rhythm guitar style which is not driven by a template. A four note chord is strummed twice at regular intervals, and strummed twice again with a potentially different voicing of chord tones. The step S94 places the return address of the process on the condition list 132 of the kernel (dDB) to wait for the next downbeat of the acoompaniment. The address remains on the condition list 132 until the "dDB" flat is signaled true, at which time the process is unblocked. Step S96 then selects a suitable chord voicing in the manner of Step S44 above. This process is a random one and is described fully in the copending application for "Accompaniment Note Selection Method", which is filed concurrently herewith. Step 198 then invokes the START primitive to place the address of the Strum routine on the ready list. This is an instantaneous entry into the kernel and does not block the process. The RWAIT primitive is then invoked to block the process for twelve rhythm clock pulses (Step S100), followed by a second starting of the Strum routine and a second RWAIT step at S102 and S104, respectively. Chord voicing is reselected in step S106, yielding a statistically different chord voicing for two additional invocations of the Strum routine in steps S108 and S112, respectively. The two strums are separated by an RWAIT for twelve rhythm clock pulses (step S110) and the process then returns to step S94 to wait for the next downbeat. It proceeds until the style or state of the instrument is changed.

As discussed above, the "harmony plus" (HP) process of the software subsection C is an independent process for embellishing a melody, as described in copending U.S. patent application Ser. No. 274,606, for Method and Apparatus for Improved Automatic Harmonization. Because the accompaniment processes of the present invention exist as discrete processes executed pseudo-concurrently through the kernel D, the process described in the referenced application can be substituted into the present system without change.

Figure 18:
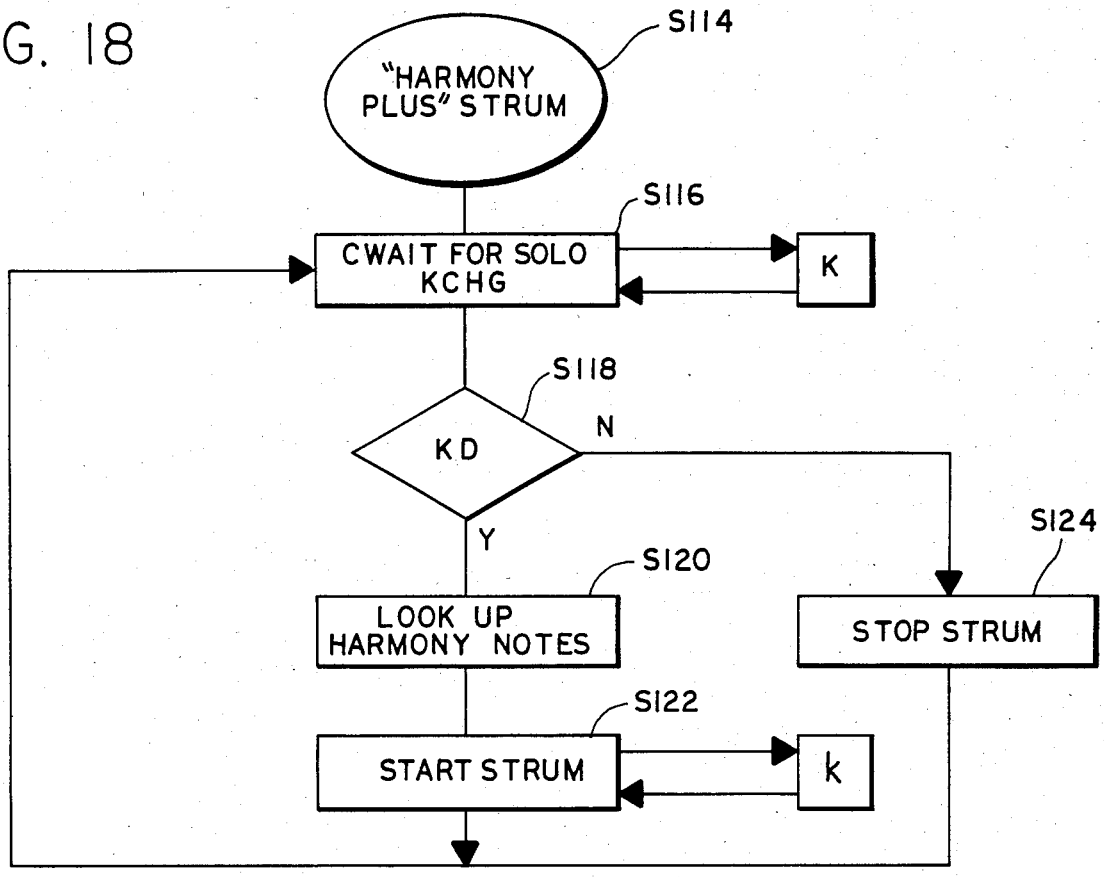
FIG. 18 is a simplified block diagram of an accompaniment process for embellishing a melody in accordance with the preferred embodiment of the present invention.

A variation of the process incorporates a strum of the harmony plus notes and is illustrated in FIG. 18. Although this process is not used in the jazz guitar style, it corresponds directly to the HP process shown in the style definition table of Table 1. In Step 116, the CWAIT primitive is invoked to place the return address of the "harmony plus" Strum routine on the condition list 138 of the kernel to block the processing until the dS0 flag is signalled "true". When that happens, inquiry is made at Step S118 as to whether a key of the solo keyboard is down. If it is, the process proceeds to Step S120 to look up the harmony plus notes in accordance with the disclosure of the referenced application. Step S122 invokes the START primitive to place the address of a strum routine on the ready list. This strum routine may be identical to the chordal accompaniment strum routine of FIG. 15, but preferably exists as a separate piece of code used only by the harmony plus routine. This is an instantaneous entry into the kernel, and therefore is represented by a lower case "k". After the harmony notes have been strummed, the routine returns to step S116 to again wait for a change in the solo keyboard. If the answer to the keydown inquiry of step 118 is ever in the negative, the process proceeds to stop the strum routine at step S124 and return to the CWAIT condition of step 116. Thus, the "Harmony Plus" Strum of FIG. 18 operates to strum a group of accompaniment notes in response to a solo key change. The harmony plus notes added to the played melody in this manner are chosen to be harmonically related to the recognized harmony as well as to the played melody.

The "Harmony Plus" Strum routine of FIG. 18 can be transformed into the more basic harmony plus process used in the jazz guitar style by replacing step S122 with the instruction "Start Play HP Notes". This invokes the START primitive of the kernel to place the address of the Play Note routine on the ready list. This causes the harmony plus notes to be sounded coincident with the played melody. In the cae of the jazz guitar style, the chords used in the process are of the standard "block" type and are voiced as a solo accordian (saccrd).

Figure 19A:
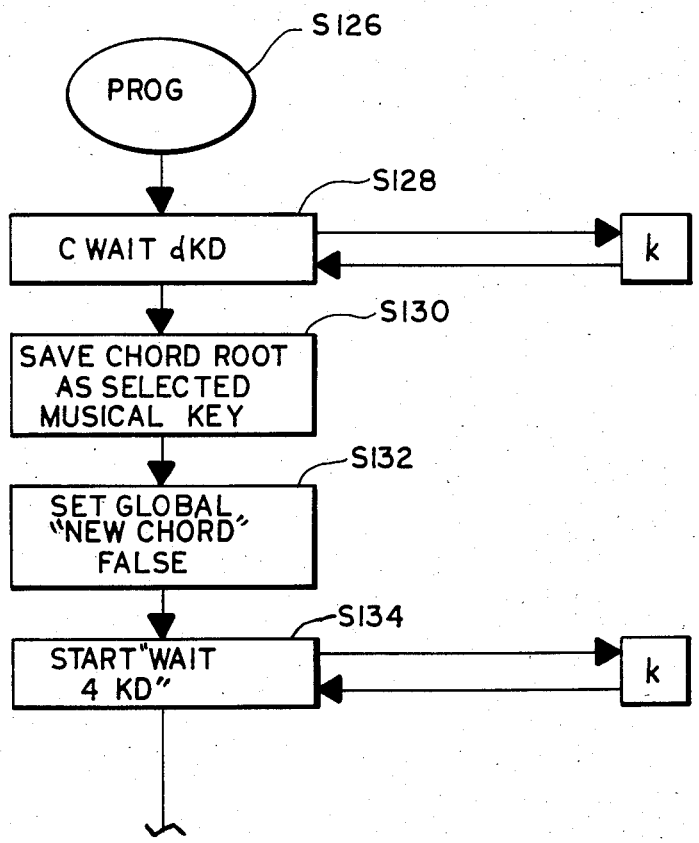
FIGS. 19*a* and 19*b* illustrate a process for implementing a chord progression in a system embodying a preferred embodiment of the present invention.
Figure 19B:
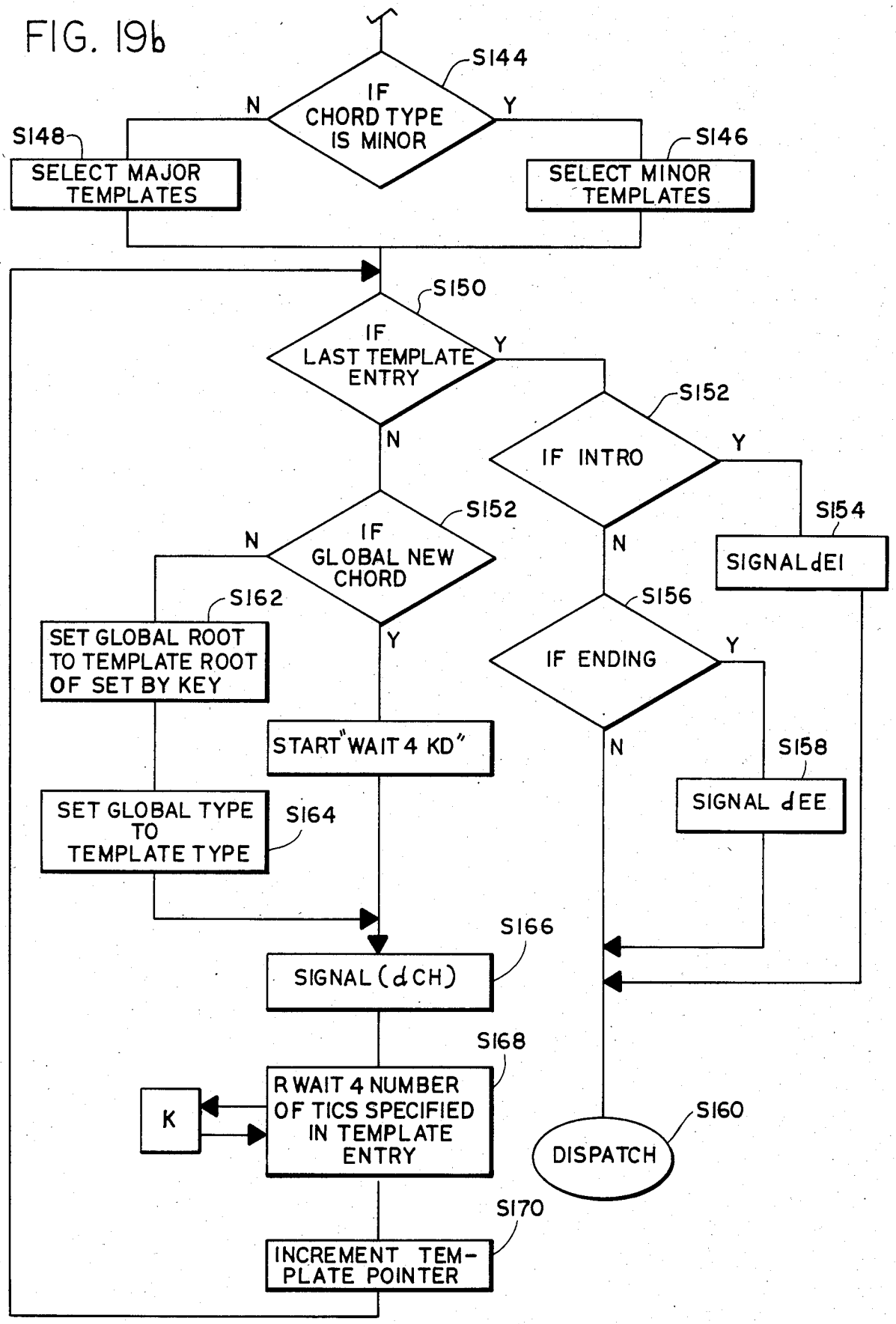

Referring now to FIGS. 19*a* and 19*b*, a chord progression process having an entry point S126 may be used in either the intro or ending states to accomplish a chord change in the musical key recognized by the instrument. This process corresponds to that listed as "PROG" in the style definition table for the jazz guitar style. The templates "cp5" and "cp8" contain chord change and timing information similar to the format of FIG. 8. They are stored in the data structure 148 along with the other rhythm templates.

The PROG process commences at step S128 by implementing the CWAIT primitive to wait for a change in the keydown flag (dKD). Associated with the dKD flag is a bistable global variable switching between a "true" condition in which at least one key of the harmony keyboard is depressed; and a "false" condition in which no harmony keys are depressed. In the case of an INTRO, as determined by the global variable I being "true", step S128 serves to postpone the beginning of the accompaniment until a harmony key is depressed. Step S128 moves the address of the tasks on the dKD condition list to the ready list, and therefore is an instantaneous entry into the kernel. Upon depression of a harmony key, step S130 saves the chord root recognized according to the method of U.S. Pat. No. 4,433,601, the specification of which has been incorporated by reference, to determine the selected musical key of the process. Step S132 then initializes the "new chord" flag as "false" and the step S134 invokes the START primitive to begin a concurrent task which is designated "Wait 4 KD". Thus, the starting address of the "Wait 4 KD" task is placed on the ready list for pseudo-concurrent processing by the microprocessor 16. The wait 4 KD task invokes the CWAIT primitive to wait for a change in the dKD flag (step S138) and then sets the global variable "New Chord" true (step S140). Control is then passed back to the kernel by calling the DISPATCH primitive (step S142). The routine "wait 4 KD" serves merely to update the global variable "New Chord" to the "true" condition when a change in keydown occurs.

Returning to the PROG process, inquiry is made at step S144 as to whether the chord type is minor. If it is, a set of minor chord templates is selected in the step S146 for use in the INTRO or ENDING. If the recognized chord type is not minor, a set of major templates is selected by default in the step 148. Implicit in the steps 146 and 148 is also the selection of a particular template within the appropriate set and initialization of a template pointer to point at an entry in the selected template.

Step S150 examines the template entry to determine whether the template flag is "true". If it is, the template is the last template and the SIGNAL primitive is invoked to force either the dEI (S154) or the dEE (step 158) flag "true". Which flag is forced true depends upon whether an INTRO or an ENDING is in progress. Control is then passed back to the kernel by the DISPATCH process of step S160. If, on the other hand, the inquiry of step 150 yielded a negative answer, indicating that the last template entry has not been encountered, a determination is made at step 152 as to whether the global variable "New Chord" is true. If the answer is "no", the process passes to steps S162 and S164 to set the global variable for the recognized chord root and the global variable for the recognized chord type to values corresponding to the root and type in the template entry. In the case of the chord root, the root information and the template must be offset by the selected musical key determined in step S130 to arrive at an appropriate value. This causes the chord progression stored in the template to be used in the INTRO or ENDING. The global variable corresponding to the recognized chord, root and type are the variables used by all of the concurrently running processes of the system to determine the accompaniment to be played. When new chord information has not been provided by the player since the beginning of the PROG process, the template root and type information is used in place of that previously in the global variables. From step 164, the process proceeds to invoke the SIGNAL primitive to force the dCH flag true, placing all processes on the dCH condition list onto the ready list to update all system processes according to the new global root and type (step S166). Step 168 invokes the RWAIT primitive to block the process for the number of rhythm clock pulses specified in the template entry, and the step S170 subsequently increments the template pointer and returns the process to step 150. The process then proceeds from step S150 through step S160 to play the INTRO or ENDING portion according to the chord and timing information of the template.

Figure 20:
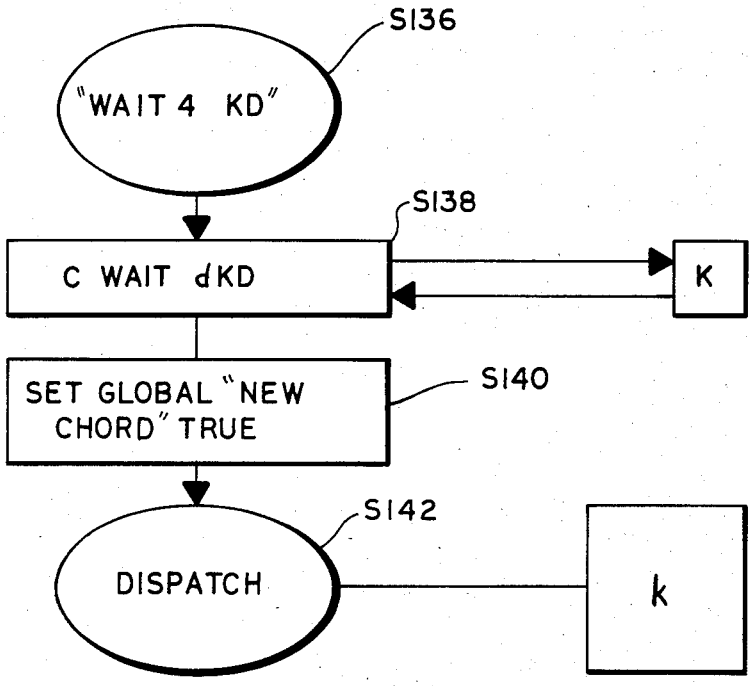
FIG. 20 is a simplified block diagram illustrating a process which waits for a change in keydown in a system embodying the preferred embodiment of the present invention.

If, however, the answer to the step of S152 is yes, i.e., new chord information has been detected through the routine of FIG. 20, the process bypasses steps S162 through S164 to override the chord information on the template with the corresponding information provided by the player. The INTRO or ENDING is played with the new chord information according to the timing scheme of the template. Once the global variable "New Chord" has been found to be true, the INTRO or ENDING will be played out in its entirety with the new chord information substituted for that of the template.

A musical rendition is often preceded by a short musical phrase that will notify the listener or a participant as to when the rendition starts, thus enabling a player, a musician, a singer, a dancer or any observer to have a common starting point. For example, a series of harmony changes properly organized in a phrase can strongly suggest the starting point of a phrase which follows. Such a series of harmony changes can be implemented by the PROG process, either for use in an introductory or ending portion of the accompaniment. An example of such a series used as an introductory portion would be:

| | | |
|---|---|---|
| TONIC CHORD | C maj | 2 beats |
| RELATIVE MINOR | A minor | 2 beats |
| SUPER TONIC MINOR | D minor | 2 beats |
| DOMINANT SEVENTH | G7th | 2 beats |
| TONIC CHORD | C maj | 2 beats |
| RELATIVE MINOR | A minor | 2 beats |
| SUPER TONIC MINOR | D minor | 2 beats |
| DOMINANT SEVENTH | G7th | 2 beats |

This sequence of chords will strongly suggest that the next beat will be a C major chord, thus providing a four bar introduction for a rendition, starting in the key of C. A common variation of the above example uses a diminished chord in place of the relative minor. There are many other variations of chord progressions that are suitable as introductions. They are particularly effective if a melody line based on the chord structure is included. A simple melody line to go with the above mentioned chord progressions is shown followed by the same melody harmonized with a second note.

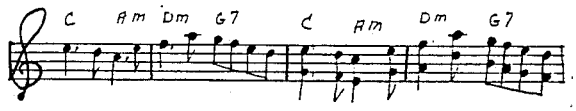

In a similar fashion a proper arrangement of successive chords or harmony changes can suggest finality to a phrase, thereby invoking an ending for the performance. A series of chromatic progressions is often used for this purpose, such as:

| | |
|---|---|
| E MINOR | 2 beats |
| E flat MINOR | 2 beats |
| D MINOR | 2 beats |
| D flat MINOR | 2 beats |
| C MAJOR 7th | 5 beats |
| TACIT | 3 beats |

A strong bass tone playing the chordal tones of the final tonic chord is also useful in expressing an ending. An example is the following:

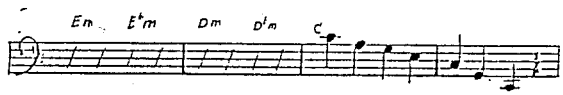

Note: The addition of the major seventh tone to the final chord is also a useful device in expressing an ending.

The system of the present invention, as disclosed herein, provides such progressions in response to the selection of an INTRO or ENDING state of the instrument.

C.1 Sharing Sound-Producing Channels

As discussed above, the system of the present invention executes a number of separate accompaniment processes in a pseudo-concurrent manner to integrate the various musical components into an integrated accompaniment scheme. This process generates a number of "virtual" channels for implementing the accompaniment, each virtual channel corresponding to accompaniment information which might be performed through one physical sound-producing channel of the instrument. A partial list of virtual channels used in the accompaniment system of the present invention is as follows:

TABLE 2

| SO | Solo |
|---|---|
| HP0 | Harmony Plus |
| HP1 | Harmony Plus |
| HP2 | Harmony Plus |
| HP3 | Harmony Plus |
| F10 | Melodic Fill & FX |
| FX1 | Melodic Fill & FX |
| C0 | Chordal Accompaniment |
| C1 | Chordal Accompaniment |
| C2 | Chordal Accompaniment |
| C3 | Chordal Accompaniment |
| B0 | Bass |
| B1 | Bass Double Stop |

These 13 "virtual channels" must be mapped into the six tone producing physical channels of FIG. 1 to produce the accompaniment. The number of physical channels is chosen to be less than the worst-case possibility for virtual channel use requiring the virtual channels to cooperate with each other to sound the accompaniment in the most acceptable way. The channels between which sharing is invoked are predetermined according to the characteristics and needs of a particular musical style, and is inherent in the processes and data of the style definition chart (Table 1 in the case of jazz guitar style). That is, the virtual channels of Table 2 are grouped together by the processes of the style definition table, such that certain of the virtual channels shown in Table 2 will share a physical channel with one or more of the other virtual channels. Typically, relatively weak or subdued tones of the accompaniment which are not crucial to the overall musical content are assigned to a virtual channel which can be preempted by a more dominant tone, such as a melody note. In this way, the absence of certain accompaniment notes in one portion of the acompaniment can be "masked" by other portions of the accompaniment so that the absence is not as noticable to the listener.

Figure 27:
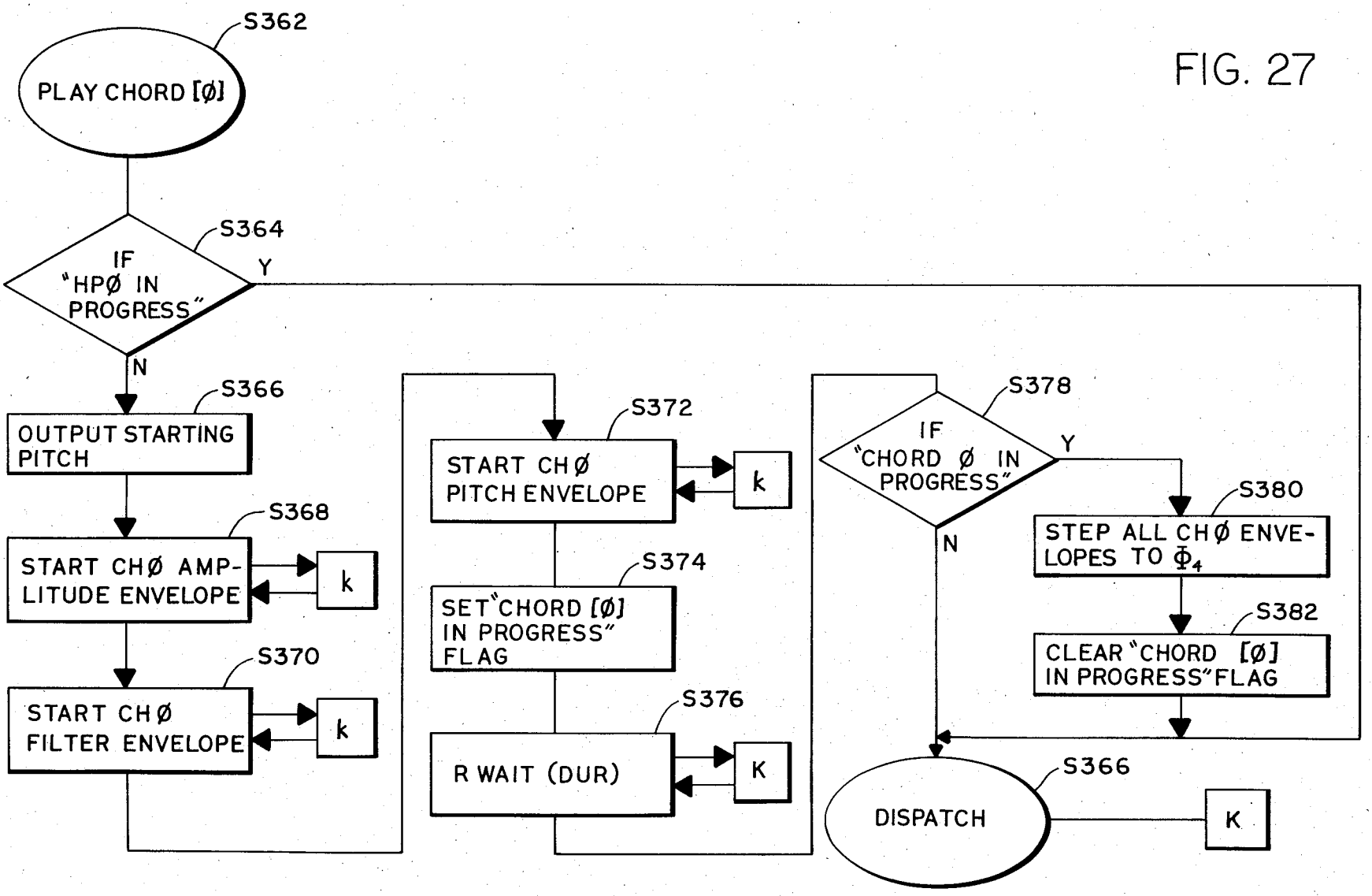
FIG. 27 is a simplified block diagram of a routine for playing a chordal component of the accompaniment in a resource-shared environment according to a preferred embodiment of the present invention.
Figure 28:
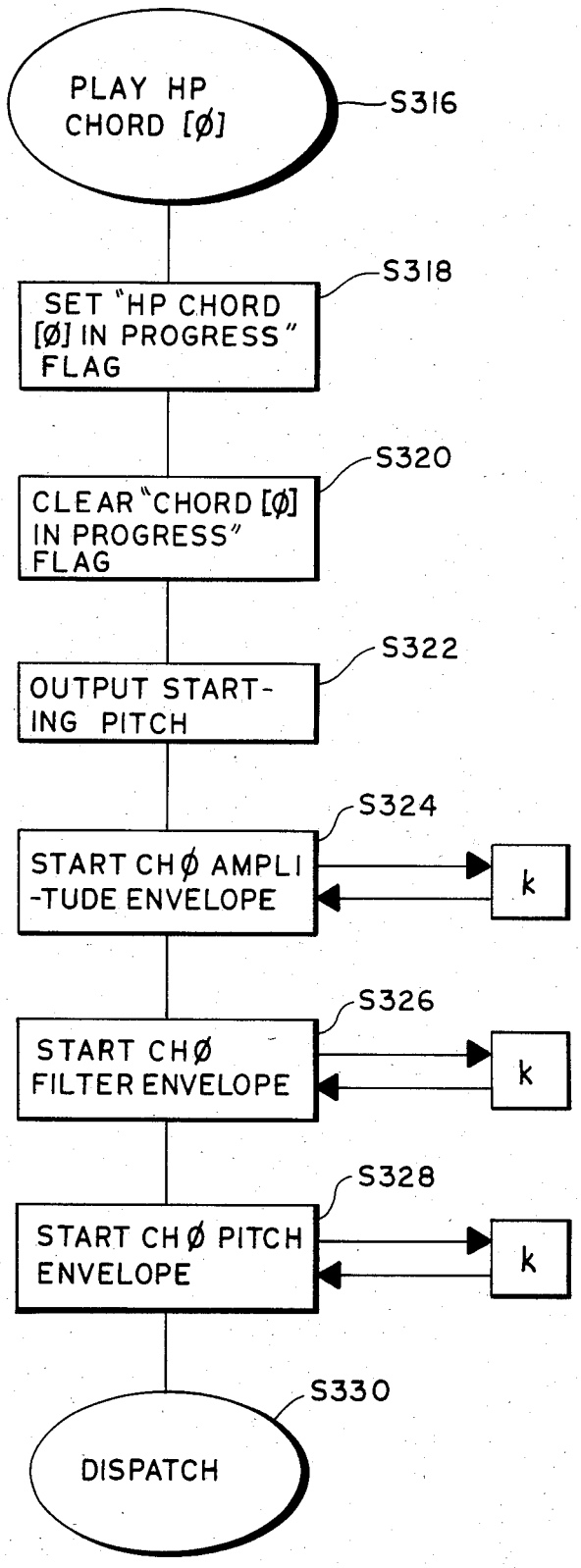
FIG. 28 is a simplified block diagram illustrating a routine for playing a fill note component of accompaniment to share physical sound producing channels with the method of FIG. 27.
Figure 31:
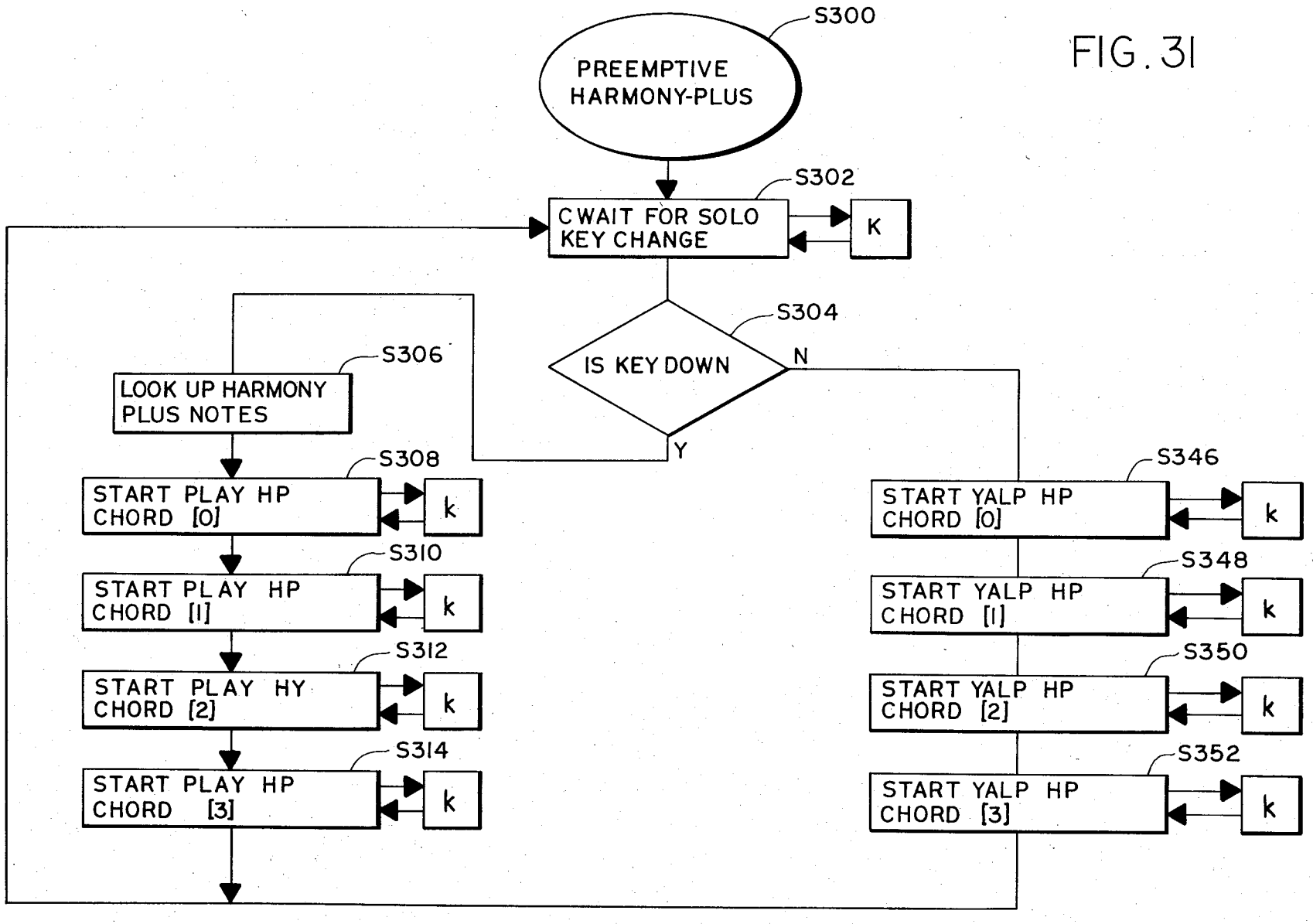
FIG. 31 is a simplified block diagram of a preemptive fill note accompaniment process according to a preferred embodiment of the present invention.

The "Preemptive Harmony Plus" process of FIG. 31, in conjunction with the "play HP Chord (0)" and "Play Chord (0)" routines, cause the fill or "Harmony Plus" components of the accompaniment to supersede the chordal component on a note-by-note basis when the two coincide. The processes of FIGS. 31, 28 and 27 are executed pseudo-concurrently by the kernel in the manner discussed above.

Referring first to FIG. 31, the "Preemptive Harmony Plus" routine proceeds from an entry point at S300 to invoke the CWAIT primitive to wait for a key change on the solo keyboard (dSO) at step S302. Because the Harmony Plus feature provides a fill note type of accompaniment in response to both solo and harmony keyboard input, it is not implemented until a solo key change occurs. At that time, inquiry is made at step S304 as to whether or not a solo key is depressed. If it is, the process proceeds to step S306, where it derives the Harmony Plus notes in the manner of step S120 of FIG. 18, and proceeds to play the Harmony Plus notes as a chord. Steps S308–S314 invoke the START primitive to place the addresses of the "play HP chord (0)", "play HP chord (1)", "play HP chord (2)" and play HP chord (3)" routines on the ready list, whereupon the "preemptive Harmony Plus process" returns to step S2 to wait for another solo key change.

The entities "HP chord (0)", "HP chord (1)", "HP chord (2)", and "HP chord (3)" are the four Harmony Plus "virtual channels" listed in Table 2. One of the four "Play HP Chord" processes started at steps S308–S314 is illustrated in FIG. 28. The process causes a note along the virtual channel "HP chord (0)" to sound on a physical sound-producing (hardware) channel "CH0". The process proceeds to set a flag "HP chord (0) in progress" (S318) and clear a flag "chord (0) in progress" (S320), before outputting a starting pitch of the note (S322). At that point, the process invokes the START primitive to move the amplitude, filter and pitch envelope processes for physical channel CH0 to the ready list (steps S324, S326 and S328). The process is then dispatched (S330) to return control to kernel.

Figure 32:
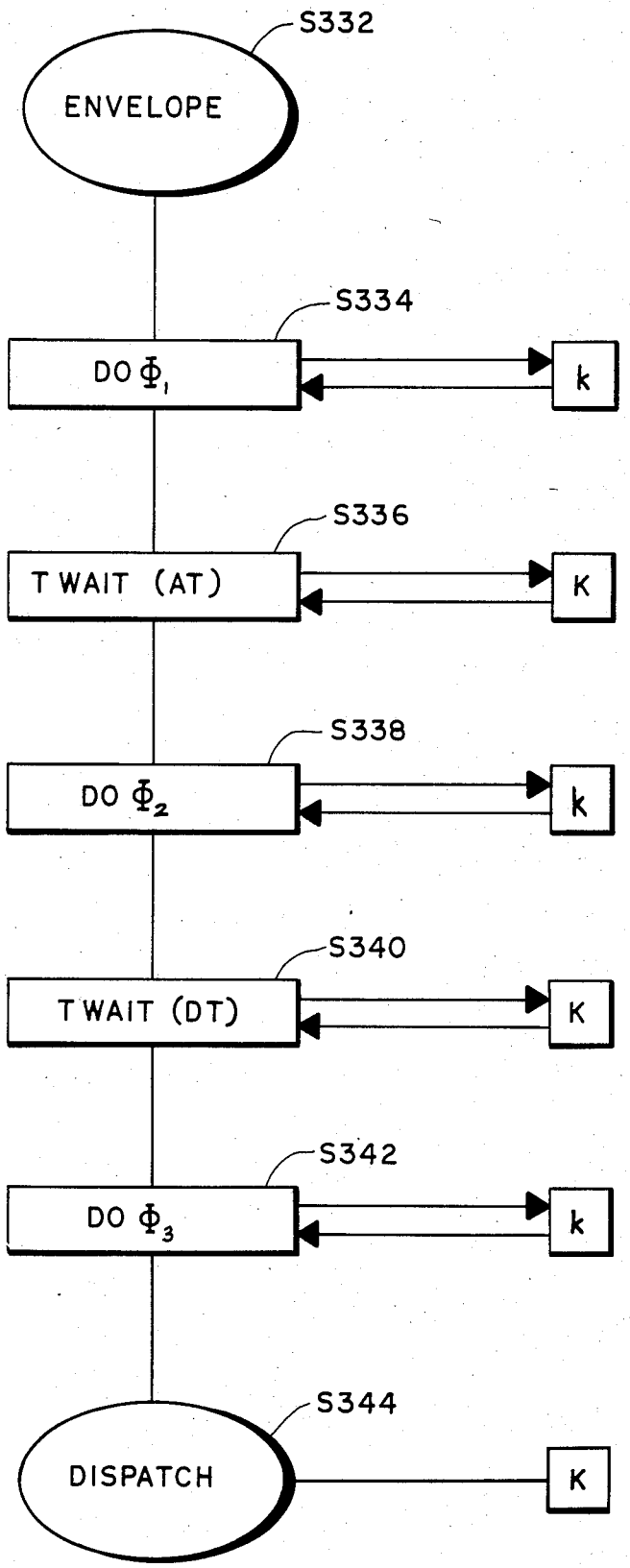
FIG. 32 is a simplified block diagram of an envelope generation routine used in a preferred embodiment of the present invention.

The envelope processes, shown in generalized form in FIG. 32, proceed from an entry point S332 to sequentially produce the first three phases of the envelope over time. Step S334 begins the first phase of the envelope ($\phi_1$), and invokes the TWAIT primitive (step S336) to wait for a number of milliseconds equal to the attack time (AT) of the note. The second phase ($\phi_2$) of the envelope is started at step S338, followed by another TWAIT at step S340 for the decay time (DT) of the note. Finally, the third phase of the envelope ($\phi_3$) is begun at step S342, and the routine is dispatched to the kernel at step S344.

Figure 29:
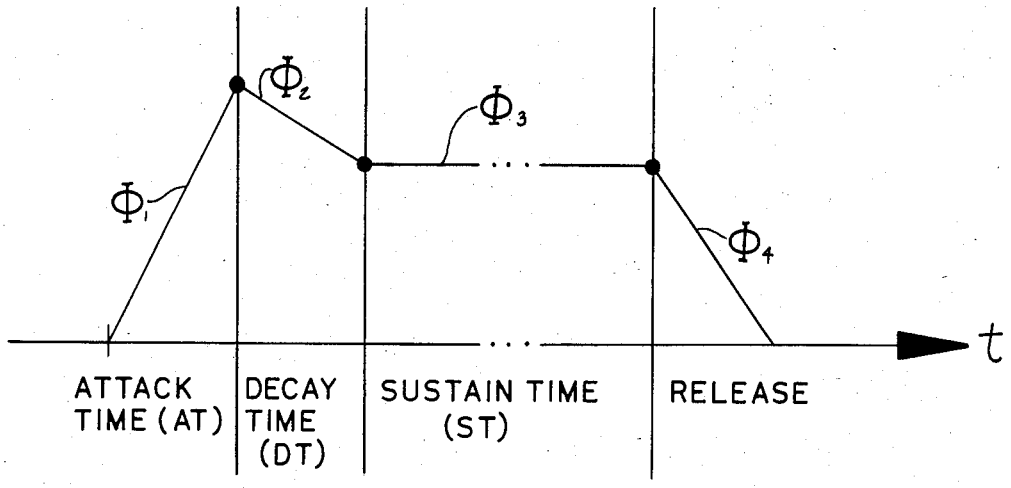
FIG. 29 is a simplified schematic representation of a parameter envelope of a note produced according to the preferred embodiment of the present invention.
Figure 30:
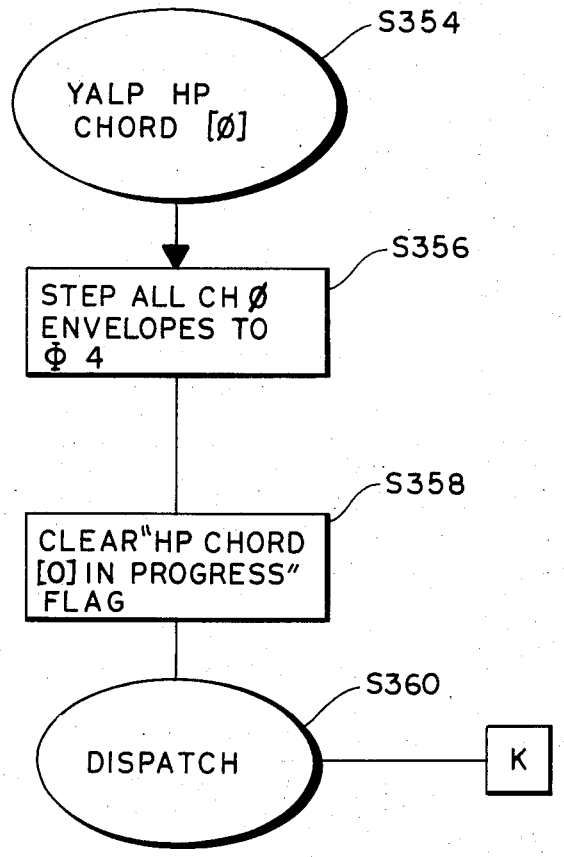

Referring to the envelope of FIG. 29, the process of FIG. 32 completes phases 1 and 2 of the envelope and begins phase 3. However, the "envelope" routine does not terminate phase 3 or invoke phase 4 itself. This is the reason for the branch of the "Preemptive Harmony Plus" process which stems from the negative response to the decision block 304. That is, if there is no solo key down after a solo key change (dSO) occurs, steps 346, 348, 350 and 352 terminate the notes begun by the steps S308–314. Specifically, the START primitive is invoked to begin four different incarnations of the "Yalp HP Chord" routine of FIG. 30. The "Yalp HP chord" routines act to commence the release phase ($\phi_4$) of the channel envelopes (step S356) and clears the "HP chord in progress" flags (step S358). It then dispatches back to the Kernel and step S360.

Therefore, the preemptive Harmony Plus process of FIG. 3 plays Harmony Plus chords on all four channels ($CH_0$, $CH_1$, $CH_2$ and $CH_3$) whenever a solo key is down, and sets in motion the termination of the notes in response to a key up. It will be appreciated that the "preemptive Harmony Plus" process must have priority on the four channels $CH_0$–$CH_3$ because there is no provision in the process for an HP note to be overridden.

The "Play Chord" process used in conjunction with the "Preemptive Harmony Plus" process of FIG. 31 is illustrated in FIG. 27. Immediately after the entry point S362, the "Play Chord (0)" process asks whether the "HP Chord (0) in progress" flag has been set. If it has, which can only occur in the "Play HP Chord (0)" process of FIG. 28 in response to the "Preemptive Harmony Plus" process of FIG. 31, then the note "chord (0)" is overridden by the "HP Chord (0) "chord and the process immediately passes to step S366 for dispatch to the kernel. In this example, it will be understood that the "Chord (0)" note makes up the virtual channel of the chordal component of accompaniment which is supplied to the channel $CH_0$, whereas the note "HP Chord (0)" is part of another virtual channel applied to the same physical channel. Thus, in this case the Harmony Plus has priority over the corresponding chordal accompaniment tone and overrides that tone if the two coincide.

If the flag "HP Chord (0) in progress" has not been set, the process of FIG. 27 proceeds to output a starting pitch (step S366) and START the amplitude, filter and pitch envelopes in steps S368, S370 and S372. Each of these steps causes the START routine to be invoked to place corresponding envelope routines on the ready list. Those routines are similar to the generalized envelope routine of FIG. 32, leaving the envelopes in the third phase ($\phi_3$) shown in FIG. 29. The "Play Chord (0)" routine then sets the "Chord (0) in progress" flag (step S374) and invokes the RWAIT primitive to wait for the number of rhythm clock pulses equal to "DUR", the desired note duration (step S376).

During the duration time of the chord note, it is possible that a melody note has been sounded and therefore that a Harmony Plus note has reset the channel tone generators by the process of FIGS. 31 and 32. This would override the earlier setting of the generators by the "Play Chord" routine of FIG. 27, terminating the chordal accompaniment notes. Thus, the routine of FIG. 27 inquires after the RWAIT step S376 as to whether the "Chord (0) in progress" flag is "set" (step S378). If it is, then the chordal accompaniment not has not been overridden by a Harmony Plus note and the channel envelopes must be stepped to phase 4 ($\phi_4$). This is accomplished at step S380, followed by clearing the "chord (0) in progress" flag at step S382. If, on the other hand, the "Chord (0) in progress" flag is not set at the time of the inquiry of step S378, then the envelope settings have been overridden by the "Play HP Chord (0)" process of FIG. 28 and need not be stepped to phase 4. Thus, the program proceeds directly to the dispatch step S366.

Figure 35:
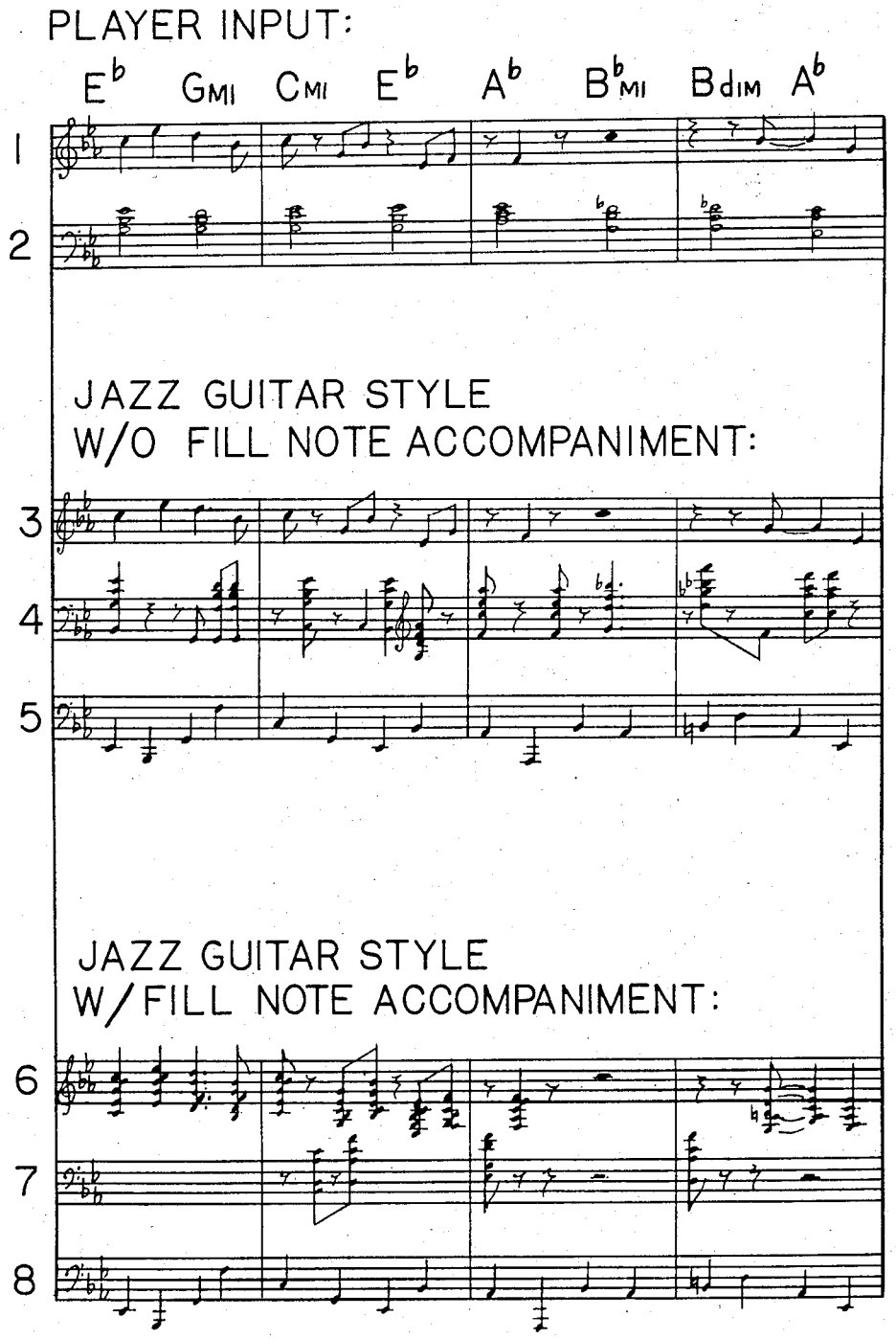
FIG. 35 is a musical representation of the player input and accompaniment output of an instrument constructed according to a preferred embodiment of the present invention.
Figure 36:
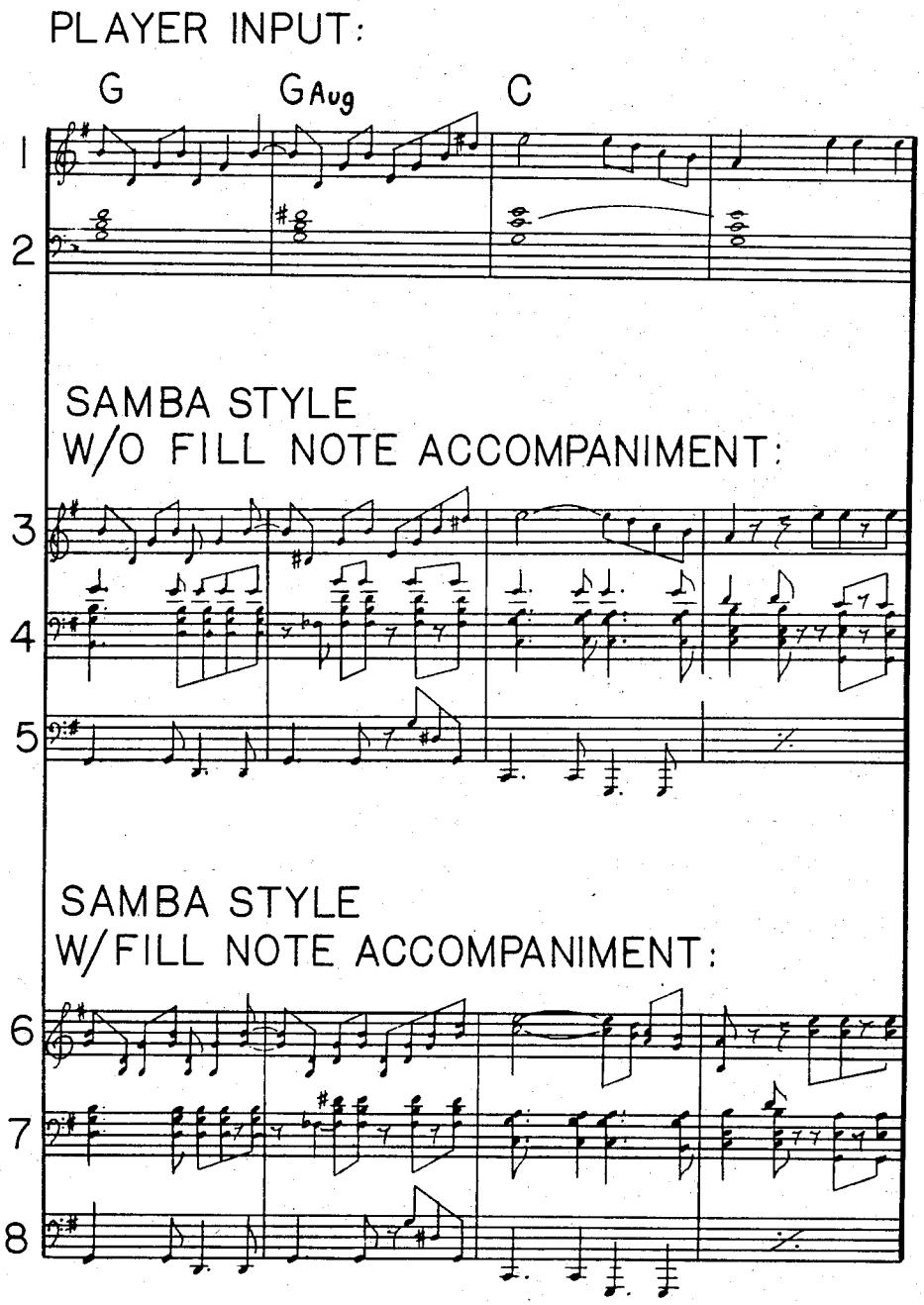
FIG. 36 is another musical representation of the player input and accompaniment output of an instrument constructed according to a preferred embodiment of the present invention.

Two examples of the preemptive Harmony Plus process are illustrated in FIGS. 35 and 36. FIG. 35 shows four bars of "September in the Rain" performed according to the jazz guitar style. Lines 1 and 2 represent to the literal keyboard input of the player, lines 3–5 represent the output of the instrument of the present invention without the fill note accompaniment feature (Harmony Plus) invoked, and lines 6–8 represent the output of the instrument with the fill note accompaniment invoked. Sharing of output channels is not required in the accompaniment of lines 3–5 because the number of notes to be sounded ("virtual channels") never exceeds the six physical sound-producing channels of the instrument. The melody line 3 is identical to the melody input by the player at line 1. The chordal accompaniment and bass lines 4 and 5, respectively, provide accompaniment in the jazz guitar style without exceeding the number of physical channels.

However, the accompaniment of lines 6–8 exceeds the number of physical channels at several locations because fill-note accompaniment in the form of block chords (see Style Definition Table) is added to each played melody note, increasing the number of virtual channels at line 6 to a total of five. This corresponds to playing all four "HP chords" by the preemptive process of FIG. 31, and suppresses all four notes of the chordal accompaniment line 7 which are coincident in time with the Harmony Plus notes. This takes place because all four "HP chord in progress" flags are set in the process of FIG. 28 to prevent the sounding of the four chordal accompaniment notes. However, the chordal accompaniment which is not coincident in time with the Harmony Plus chords continues to be sounded, filling out the accompaniment in an interesting and sophisticated manner. In fact, the preemption of chordal accompaniment notes coincident with Harmony Plus notes and the sounding of them in the absence of Harmony Plus notes gives the accompaniment a unique feature by which the chordal component appears to "answer" the embellished melodic line.

A more limited preemption of chordal accompaniment notes by the Harmony Plus process is illustrated in FIG. 36 with reference to a rendition of the "Tamborine Samba". Again, lines 1 and 2 correspond to player input, lines 3–5 represent the output of the instrument without the fill note (Harmony Plus) feature invoked, and lines 6–8 represent the output of the instrument in the samba style with the fill-note accompaniment feature invoked. Lines 1 and 3 have a one-to-one correspondence, while lines 4 and 5 provide chordal and bass line accompaniment, respectively, in accordance with the style. No preemption occurs because the number of accompaniment notes never exceeds six. In the case of line 6, additional fill notes are added to embellish the melody in the manner of a duet, causing the total number of virtual channels to exceed the number of physical channels at certain locations by one. In the example of FIG. 36, this is accomplished by eliminating the highest note of the chordal component of the accompaniment wherever the chordal component is coincident in time with a Harmony Plus note. In fact, all but one of the accompaniment chords is reduced in this manner. The unreduced chord is the second in the final bar of line 7, which coincides with a pause in the melody line. This limited form of preemption is accomplished in the same manner as that of FIG. 35, but only as to one of the physical channels. The preempted note is the one which shares a physical channel with the Harmony Plus note, and is chosen to be the least noticeable in its absence. This determination is made by the programmer of the instrument and is inherent in the accompaniment process and data of the style definition table. In many styles, the note which can be most easily eliminated is the lowest note of the chord rather than the highest note.

Figure 33:
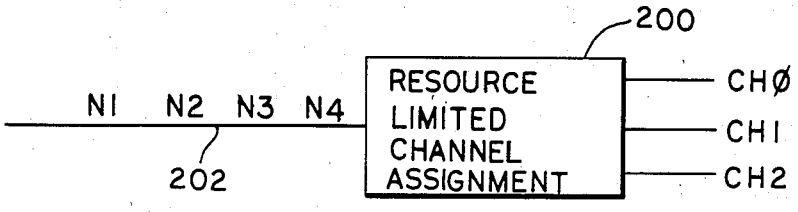
FIG. 33 is a simplified schematic representation of an alternative system for assigning channels in a resource-limited context.
Figure 34A:
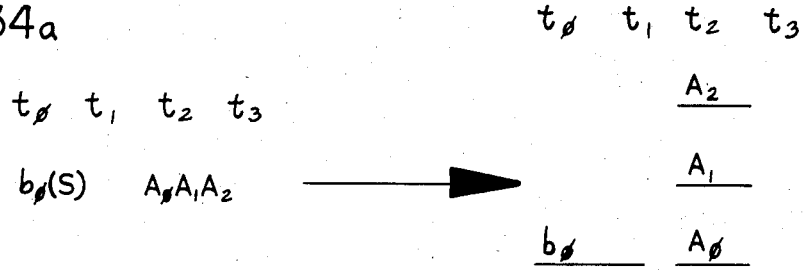
FIGS. 34*a*, 34*b*, 34*c* and 34*d* are simplified representations of specific examples illustrating the function of the system of FIG. 33.
Figure 34B:
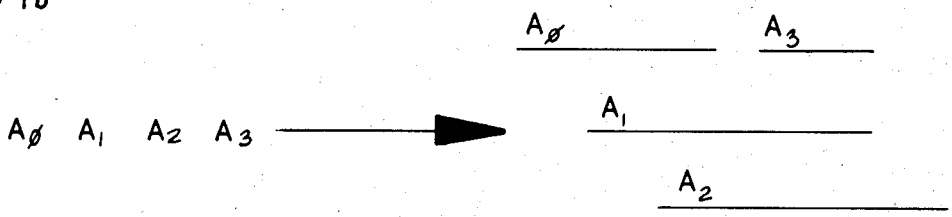

A more general form of prioritization is illustrated in FIG. 33, wherein a resource limited channel assignment device 200 to which a number of units of note information N1 through N4 are imput serially at 202 for allocation along a lesser number of physical sound producing channels (CH0 through CH4). Unlike the "Preemptive Harmony Plus" routine of FIG. 31, the device 200 maps virtual or "musical" channels into a fewer number of physical channels by taking advantage of the spacings and limited durations of the notes. As long as some of the notes of a musical segment or phrase are separated sufficiently in time, the device 200 can reassign the channel used for the first note in time to play the second in time. In this manner, all the notes are played, with some channels serving to play notes from more than one virtual channel. This situation is illustrated in FIGS. 34*a* and 34*b*. In 34*a*, a short bass note $B_0$ is sounded at one point in time, followed by three substantially concurrent accompaniment notes $A_0$, $A_1$ and $A_2$. Because the bass note $b_0$ is relatively short in duration, it terminates before any of the accompaniment notes are sounded, permitting all of the notes to be sounded at the appropriate times. The physical channel producing the notes $b_0$ and $A_0$ is reprogrammed after the $b_0$ to perform the accompaniment note. FIG. 34*b* is similar in concept, except that sharing occurs within a single component of the accompaniment. Thus, four chordal accompaniment notes ($A_0$, $A_1$, $A_2$ and $A_3$) are sounded over a time frame, with the note $A_0$ terminating before sounding of the note $A_3$. The physical channel sounding the note $A_0$ is reprogrammed before the note $A_3$ so that all of the notes can be heard.

Figure 34C:
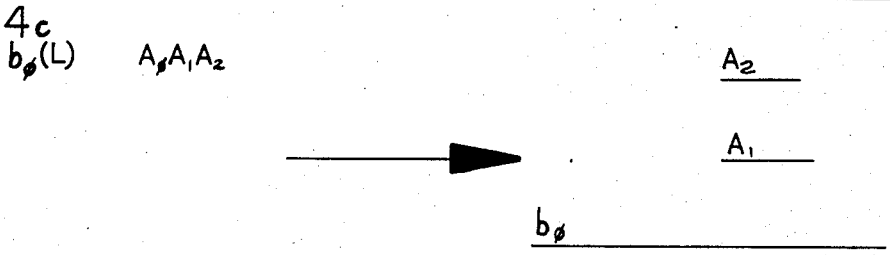

FIG. 34*c* represents a case in which a sustained bass line note $b_0$ is sounded at one point in time, followed by simultaneous note information for three accompaniment notes ($A_0$, $A_1$ and $A_2$). In this example, the sustained bass line note overrides one of the chordal accompaniment notes, causing the note $A_0$ not to be sounded. This example can be seen as invoking an algorithm by which a single note phrase, or possibly of any bass line phrase, is given the highest priority.

Figure 34D:
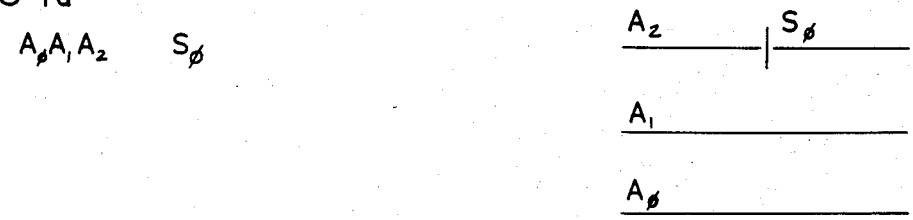

FIG. 34*d* illustrates a case in which a sustained chord made up of $A_0$, $A_1$ and $A_2$ is sounded prior to a solo note $S_0$. In this case, the solo note supersedes the chordal accompaniment note $A_2$ according to the concept that sustained chord notes have lower priority or that a solo note has priority over a chordal note. Another algorithm, which is not specifically dealt with in the figures, is that the least recently used note is replaced.

Although the processes by which channel assignment is invoked according to a desired algorithm is not described in detail in connection with the embodiment of FIG. 33, it is believed that implementation of the algorithms described herein are within the capability of a worker skilled in the art.

D. Input Responsive Software

The software responding to system inputs, corresponding to subsection D of the software diagram of FIG. 3, receives input from a player 168, a timer 170 and a rhythm clock 172. Interrupt response software 174 acts in response to hardware interrupts of a plurality of input devices to pass information concerning changes in the "rhythm time" of the accompaniment (ΔRT), changes in the true elapsed time (ΔTT), changes in the keypad sttus (ΔKP), changes in the effects input (ΔFX9 and changes in the keyboard input (ΔKB). The rhythm time software provides the state controller software A in the accompaniment software C with downbeat information, and provides rhythm pulse information to the template select software (TPS) 156. The ΔTT input provides a clocking function for the microprocessor in certain of the accompaniment processes of the software subsection C. The ΔKP and ΔFX information is decoded to vary the tempo (through the rhythm clock 172), the style (through the state controller A) and to vary the style, the variation, the FX condition and abort a style, (all through the state controller A). The keypad and FX information is also used to revoice the output of the instrument. The keyboard information is broken down into lefthand and righthand keyboard data, the lefthand corresponding to the harmony input and the righthand to the solo or melody input of the instrument. The lefthand information gives rise to chord root and type data and controls the dLH flag.

Figure 13:
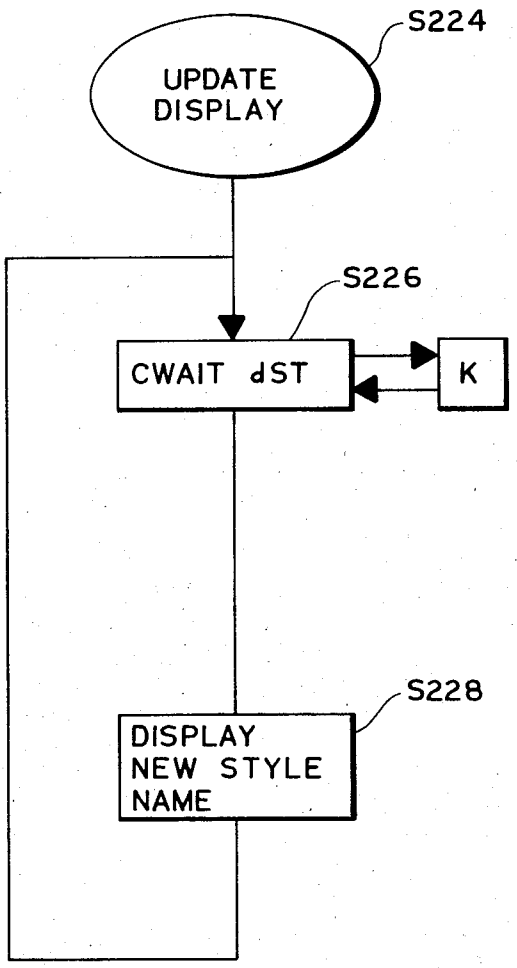
FIG. 13 is a display update routine used in a preferred embodiment of the present invention.
Figure 11:
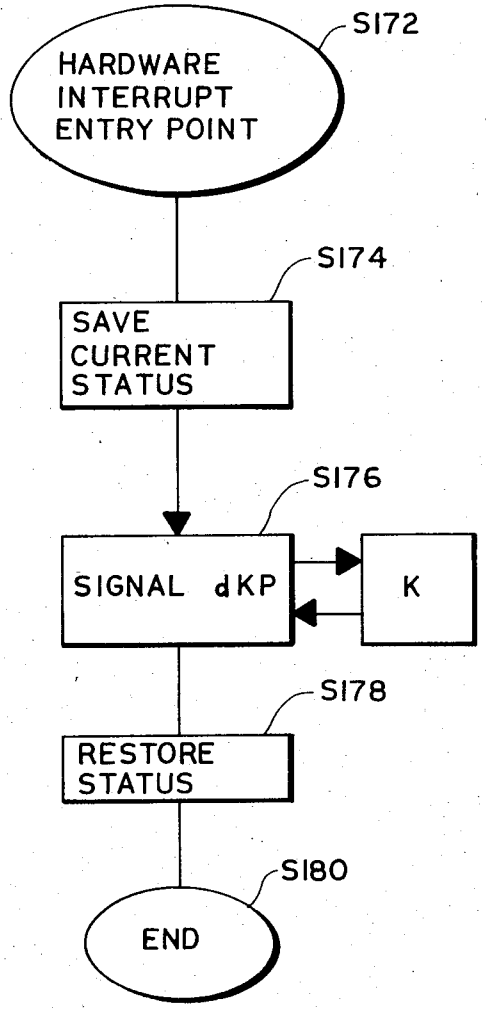
FIG. 11 is a simplified block diagram of a routine responsive to hardware input in the preferred embodiment of the present invention.
Figure 12A:
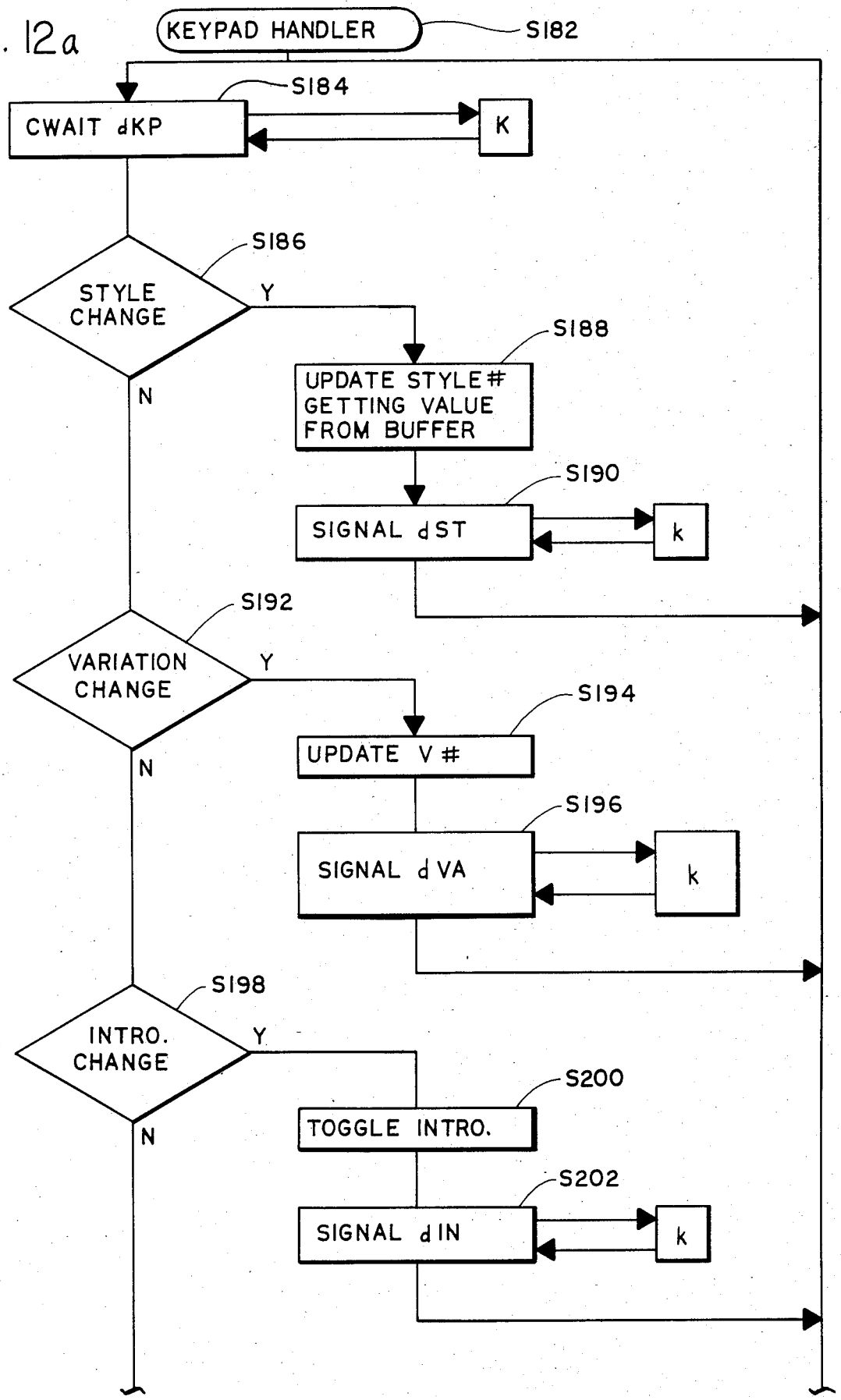
FIGS. 12*a* and 12*b* make up a simplified block diagram illustrating a routine responsive to keypad input in the system of the present invention.
Figure 12B:
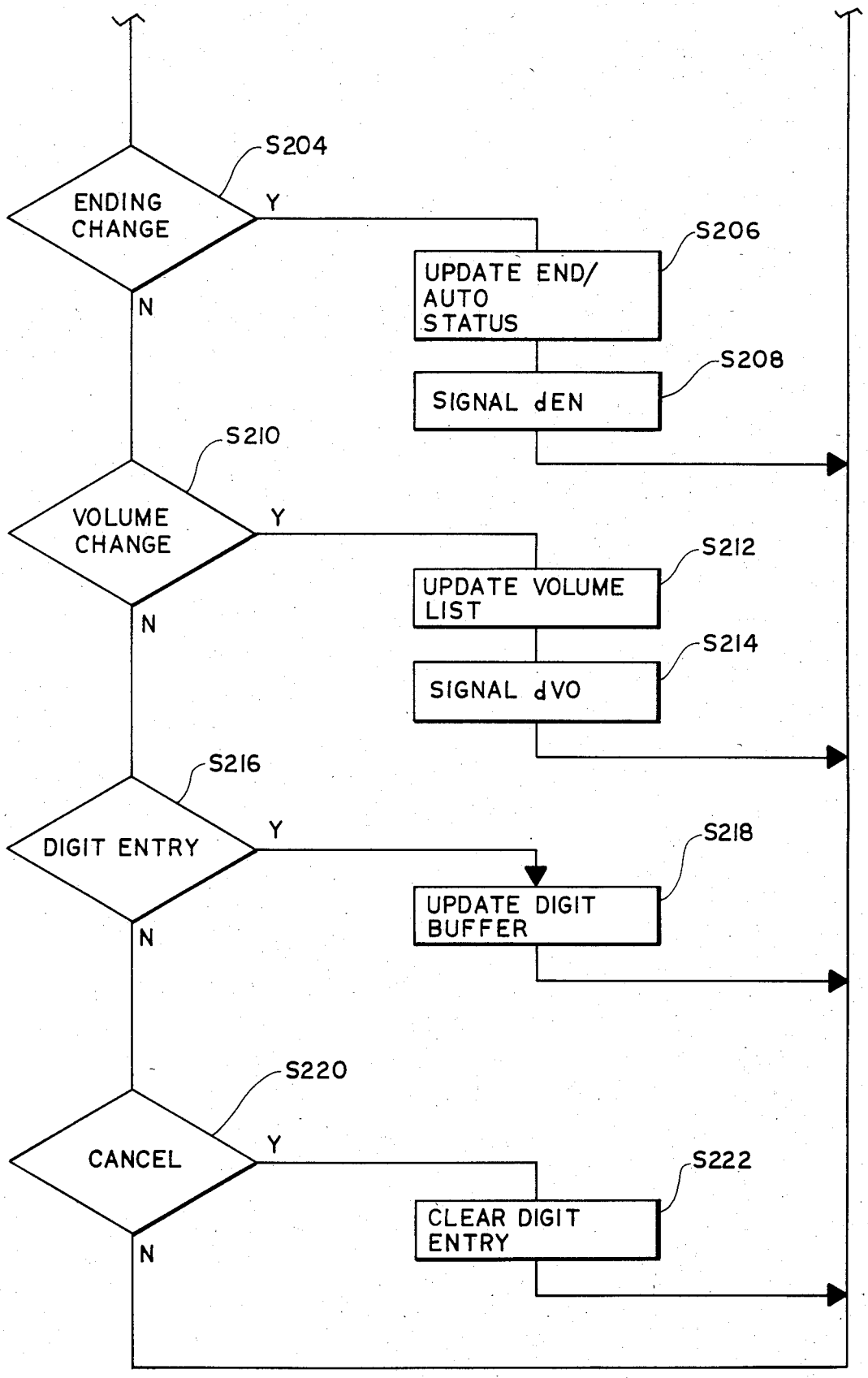

Certain of the software routines of the input response subsection B are described in FIGS. 11–13. With reference to FIG. 11, a hardware interrupt at the entry point S172 causes the current status to be saved (step 174) and causes the flag dKP (keypad change) to be forced "true" (step 176). The current status of the instrument is restored in step S178, and the routine ends at step S180. The purpose of the routine is to implement step S176, which triggers the Keypad Handler Routine of FIGS. 12*a* and 12*b* for which the entry point is S182.

The Keypad Handler Routine immediately invokes the CWAIT primitive to wait for the flag dKP (step S184). If the dKP flag is true, the routine makes a series of tests to determine what form of input has been provided. The input can be either a change in selected style, a change in the selected variation of a style, a change in the INTRO status, a change in the ENDING status, a change in the volume or a simple digit entry.

Step S186 tests for a change in style, which is accomplished by entering a number via the ten numerical push buttons 42 of FIG. 2, and subsequently depressing the "style" push button 44. Until the style push button is depressed, the numerical input is maintained in suitable buffers of conventional design. Step S188 updates the global variable containing the style number by reading the value from the buffer. Step S190 then invokes the SIGNAL primitive to force the dST flag "true". The process then returns to step S184, where it is blocked until the dKP flag is again true.

If a style change has not been indicated, the input is tested at S192 to indicate whether the variation buttons 46 have been depressed. Upon selection of a style, the instrument initially operates by default in the V0 variation. Either the V1 or V2 variations can be invoked by depressing one of the push buttons 46, and the system can be switched back to the variation V0 by depressing the same push button a second time. This "toggles" the system back to the original condition, as shown in the major state diagram of FIG. 5. When a variation has been changed, the process updates the global variable corresponding to variation number (S194) and invokes the SIGNAL primitive to force the dVA flag "true" (step S196). The program then returns to step 184.

If a variation has not been changed, step S198 tests for a change in the INTRO status caused by depressing the "I" button 46. If the INTRO status has been changed, the Keypad Handler Routine toggles the INTRO variable (step S200) and signals dIN (step S202). In "toggling" the INTRO variable, the step S200 switches back and forth between the introductory and body portions of the accompaniment by by successive depressions of the "I" push button 46.

If the INTRO status is not changed, the same inquiry is made with regard to the ENDING in step S204. If the answer is affirmative, the ending/auto status is updated in step 206 and the flag dEN is signaled in the step 208. The ending and auto statuses are determined by depressing the "E" and "A" push buttons 46.

If the ending status has not changed, the program inquires at step S210 as to whether the volume has been changed. If it has, as by operation of any of the volume push buttons 48 or 50 of the keypad 34, the data values in a volume list are updated (step S212). The flag dVO is then signaled in the step S214 to run all processes responding to a volume change.

If the volume has not been changed, the step S216 determines whether a digit entry has been made through the pushbuttons 42. If so, the digit buffer is updated in the step S218 to reflect the entry. If the keypad change is not a digit entry, the keypad handler routine determines at step S220 whether the "cancel" pushbutton of the keypad has been depressed. If so, any digit entry in the buffer is cleared (S222). If none of the listed entries has been made, as in the case of an invalid entry on the keypad, the keypad handler routine returns to step S184 to wait for a valid entry.

Another piece of input responsive software is the "Update Display" routine of FIG. 13, beginning with the entry point S224. The initial step S226 invokes the CWAIT primitive to block the routine until the dST flag is true. This entry in the kernel is designated with a "K" because it is a blocking entry. When a change in style has been indicated by the step S190 of the keypad handler routine, the process proceeds to display the new style name at step 228. The display of the present instrument is a one line LCD display containing style and other information in a very simple form.

E. Software Controlling Output Hardware

Figure 10:
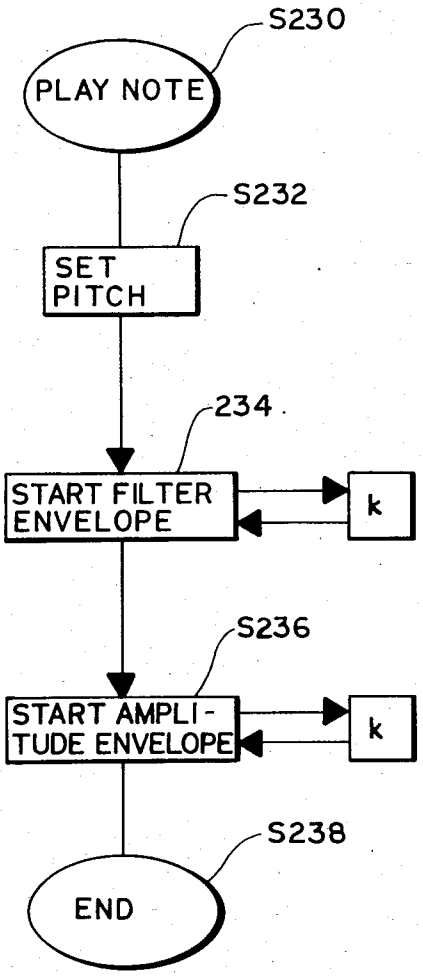
FIG. 10 is a simplified block diagram of an output control process of the preferred embodiment of the present invention.

Other than the "update display" routine of FIG. 13, the principal piece of software controlling output hardware is the "Play Note" routine of FIG. 10. The routine is called repeatedly by the software of subsection C to produce the audible accompaniment of the present invention. The routine proceeds from an entry point S230 to set the pitch of the desired note (step S232) and start concurrent processes defining the filter envelope (step S234) and amplitude envelope (step S236) of the note. The play note routine then reaches its end (S238) and ceases to exist. The Play Note routine is the principal mechanism for playing a note of the melody, a note embellishing the melody, or a note of the chord or bass line accompaniment. The Play Note routine of FIG. 10 is the same as the "play note" routine of FIG. 16, as well as the "play chord note" routine of FIGS. 14 and 15. Similar routines exist to control drum output hardware.

System Operation

Figure 9:
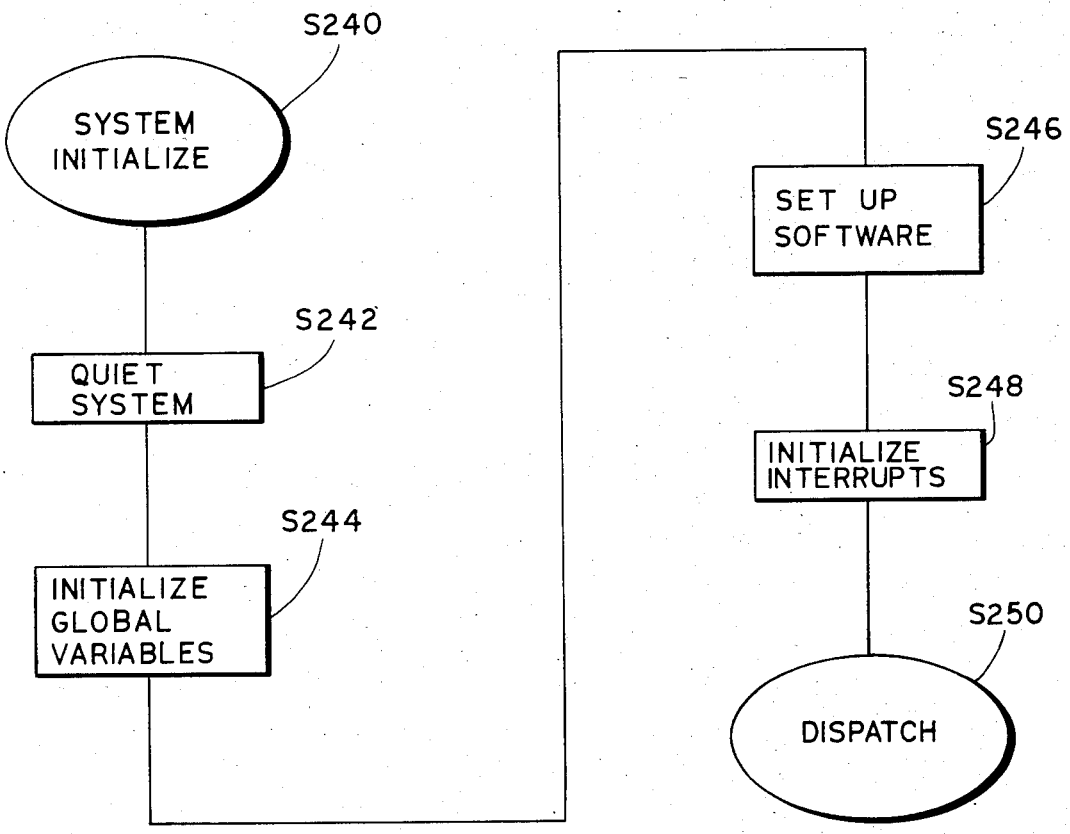
FIG. 9 is a block diagram of the initialization process of a system programmed according to a preferred embodiment of the present invention.

Operation is begun with the initialization sequence of FIG. 9 wherein the entry point S240 corresponds to power up or reset of the instrument. The initialization sequence is designed to cause an orderly beginning when the instrument is turned on or reset. In Step 242, all output channels are set in a known and acceptable state, i.e., silence, so that no sound will be made. Step S244 initializes the "global variables" which are accessible by the psuedo-concurrently operating routines. These variables include software counters, timer variables, queue pointers, and state variables. Step S246 comprises a group of commands to set up software tables, including initializing pointers, making lists of data structures and variables and initializing flags. Step S248 then initializes interrupts by programming external timers and setting up interrupt vectors, whereupon the process is dispatched to the kernel (Step S250).

Figure 4:
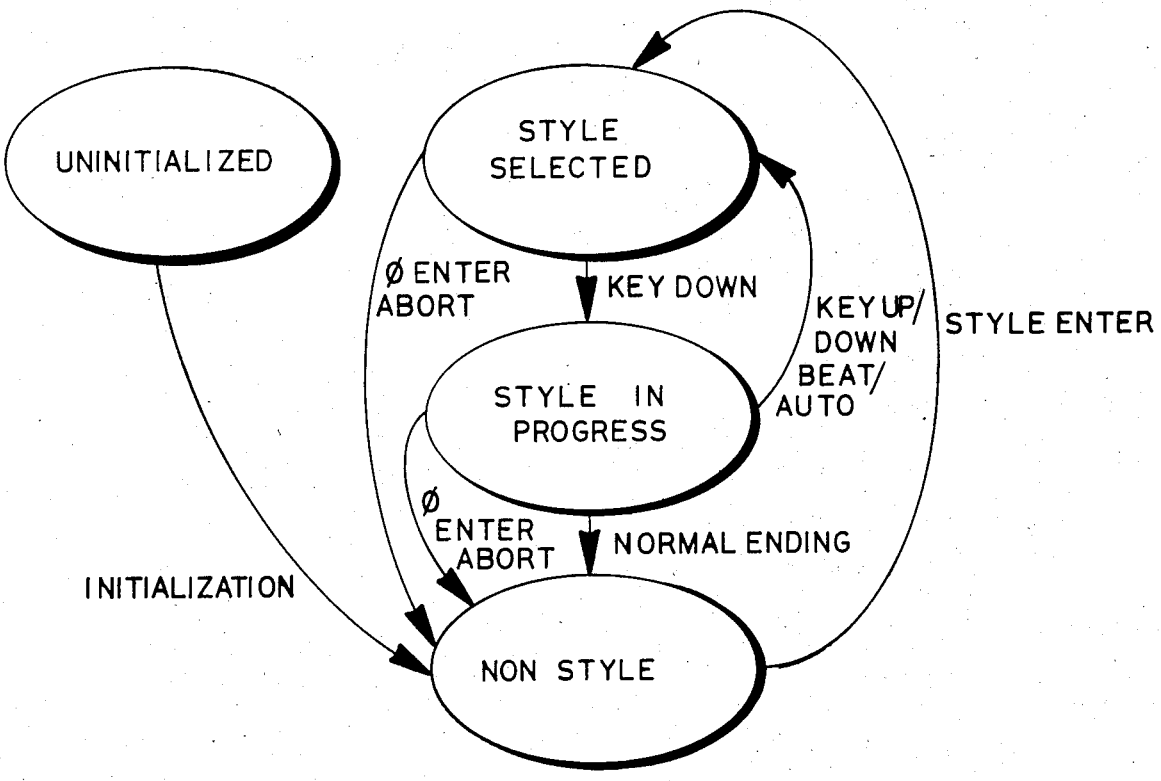
FIG. 4 is a simplified overall state diagram showing the operational states of the system of the present invention.

Upon initialization, the instrument enters the "non-style" state of FIG. 2 and passes to the "style selected" state by entering a style number on the keypad 34. When a key is depressed on the harmony keyboard, the system enters the "style in progress" state of FIG. 4, represented by the twelve INTRO, BODY, FX, and ENDING states of FIG. 5. As described above, the instrument is switched between the various states by modification of a plurality of state variables (I, E, V1, V2, AUTO, and FX) and flags (KB, EOI, and EOE). When one of the style in progress states is entered, the plurality of accompaniment processes listed in the software subsection C of FIG. 3 are implemented for execution by the microprocessor 16 (FIG. 1) on a pseudo-concurrent basis. The execution is accomplished by maintaining the processes on a number of wait lists, either waiting for conditions, waiting for absolute times, or waiting for rhythm-related times, and are individually elevated to the ready and running states for access to the microprocessor. The scheduling and interaction of the processes is accomplished by the six basic "primitives" of the kernel D, which are described in detail above. The processes are stored independently and exist as discrete entities and it is possible to vary them independently of one another without disrupting the operation of the overall system.

As accompaniment note information is generated, defining virtual channels of the instrument, the processes described above act to map those channels into the physical sound-producing channels of the instrument. When the virtual channels exceed the physical channels, groups of simultaneous events on the virtual channels must be reduced to the number of physical channels according to musically sound principles. This can be achieved dynamically in a system of the present invention by reprogramming the output channels to play the most musically significant notes.

From the above, it can be seen that there has been provided a system for producing sophisticated and coherent musical accompaniment utilizing a minimum number of physical sound-producing channels and, in some cases, enhancing the musical effect by selectively superseding an accompaniment line when its notes are coincident in time with another musical line in the accompaniment.

While certain specific embodiments of the invention have been disclosed as typical, the invention is, of course, not limited to these particular forms, but rather is applicable broadly to all such variations which fall within the scope of the appended claims. As an example, the instrument need not be a keyboard type instrument, but may be a fretted or other form of musical instrument to which it is desired to provide automatic accompaniment features. In addition, the present invention is not limited to a system involving a single microprocessor, but would normally involve one or more microprocessor operable as a single processing system.

What is claimed is:

1. In a method for providing musical accompaniment in response to the playing of a musical instrument, wherein the accompaniment has a plurality of musical components performing different musical functions, the improvement comprising the steps, accomplished by the instrument itself, of:

providing access to a first preselected number of physical sound-producing channels;

defining a second preselected number of virtual channels which effectively function as physical sound-producing channels, each of the virtual channels corresponding to a musical component which might be sounded through one of the physical sound-producing channels;

generating accompaniment information for said second preselected number of virtual channels to implement said plurality of musical components, the second preselected number exceeding the first preselected number at least once during the playing of the instrument; and mapping the virtual channels into the physical channels such that the allocation of physical channels between said plurality of musical components fluctuates over time.

2. The method of claim 1 wherein:

the virtual channels are assigned different priorities; and the virtual channels are mapped into the physical channels according to said priorities.

3. The method of claim 2 wherein:

at least one virtual channel performing a first preselected musical function is always higher in priority than at least one other virtual channel performing a second musical function.

4. The method of claim 3 which further comprises:

varying the number of virtual channels performing said first preselected musical function over time; and causing the allocation of physical channels to the virtual channels performing said second preselected musical function to fluctuate in response to said variation.

5. The method of claim 2 wherein:

accompaniment information is generated at different times in the virtual channels;

the virtual channels are assigned equal priority; and the virtual channels are mapped into the physical channels in the order that accompaniment information is generated in the virtual channels.

6. The method of claim 1 wherein:

a first of said musical components comprises a chordal accompaniment;

a second of said musical components comprises a fill note accompaniment.

7. The method of claim 6 wherein:

a third of said musical components comprises a bass figure of the accompaniment.

8. The method of claim 1 wherein:

a first of said musical components comprises a chordal accompaniment; and a second of said musical components comprises a melodic figure of the accompaniment.

9. In a method for providing musical accompaniment in response to the playing of a musical instrument, wherein the accompaniment has a fill note component and at least one other musical component performing a different musical function, the improvement comprising the steps, accomplished by the instrument itself, of:

providing access to a first preselected number of physical sound-producing channels;

defining a second preselected number of virtual channels which effectively function as physical sound-producing channels, each of the virtual channels corresponding to a musical component which might be sounded through one of the physical sound-producing channels;

generating accompaniment information for said second preselected number of virtual channels to implement said fill note component and said at least one other musical component of the accompaniment, the second preselected number exceeding the first preselected number at least once during the playing of the instrument; and mapping the virtual channels into the physical channels such that the allocation of physical channels between said plurality of musical components fluctuates over time.

10. The method of claim 9 wherein:

the virtual channels are assigned different priorities; and the virtual channels are mapped into the physical channels according to said priorities.

11. The method of claim 9 wherein:

accompaniment information is generated at different times in the virtual channels;

the virtual channels are assigned equal priority; and the virtual channels are mapped into the physical channels in the order that accompaniment information is generated in the virtual channels.

12. In a musical instrument for providing a musical accompaniment having a plurality of musical components performing different musical functions in response to a played input, the improvement comprising:

a first preselected number of physical sound-producing channels;

means for defining a second preselected number of virtual channels which effectively function as physical sound-producing channels, each of the virtual channels corresponding to a musical component which might be sounded through one of the physical sound-producing channels;

means for generating accompaniment information for said second preselected number of virtual channels to implement said plurality of musical components, the second preselected number exceeding the first preselected number at least once during the playing of the instrument; and means for mapping the virtual channels into the physical channels such that the allocation of physical channels between the plurality of musical components fluctuates over time.

13. The instrument of claim 12 wherein the mapping means comprises:

means for assigning different priorities to the virtual channels; and means for mapping the virtual channels into the physical channels according to said priorities.

14. In a musical instrument for providing musical accompaniment in response to a played input, wherein the accompaniment has a fill note component and at least one other musical component performing a different musical function, the improvement comprising:

a first preselected number of physical sound-producing channels;

means for defining a second preselected number of virtual channels which effectively function as physical sound-producing channels, each of the virtual channels corresponding to a musical component which might be sounded through one of the physical sound-producing channels;

means for generating accompaniment information for said second preselected number of virtual channels to implement said fill note component and said at least one other musical component of the accompaniment, the second preselected number exceeding the first preselected number at least once during the playing of the instrument; and means for mapping the virtual channels into the physical channels such that the physical channels are allocated between said fill note component and said at least one other musical component.

* * * * *